US006095660A

United States Patent [19]

Moriyama et al.

[11] Patent Number: 6,095,660

[45] Date of Patent: Aug. 1, 2000

[54] EQUIPMENT USING MOUNTING HOLE OF CEILING AS FIXING ELEMENT AND ACCESSORY DEVICES

[75] Inventors: Hideo Moriyama; Kazuaki Murata; Masayuki Katougi, all of Tokyo, Japan

[73] Assignee: Moriyama Sangyo Kabushiki Kaisha, Japan

[21] Appl. No.: 09/302,725

[22] Filed: Apr. 30, 1999

Related U.S. Application Data

[62] Division of application No. 08/849,672, Jun. 16, 1997.

[51] Int. Cl.[7] ..... F21S 8/00

[52] U.S. Cl. ..... 362/147; 362/147; 362/148; 362/365; 362/404; 362/276; 362/802; 362/427

[58] Field of Search ..... 362/147, 148, 362/365, 404, 276, 802, 427

[56] References Cited

U.S. PATENT DOCUMENTS

| | | | |
|---|---|---|---|
| 4,538,214 | 8/1985 | Fisher et al. | 362/147 |
| 4,947,297 | 8/1990 | Druffel et al. | 362/147 |
| 5,077,650 | 12/1991 | Cestari | 362/365 |
| 5,111,370 | 5/1992 | Clarkl | 362/147 |
| 5,432,500 | 7/1995 | Scripps | 340/628 |

*Primary Examiner*—Sandra O'Shea
*Assistant Examiner*—John A. Ward
*Attorney, Agent, or Firm*—Morrison Law Firm

[57] ABSTRACT

The present invention relates to a fixture to be mounted in a mounting hole in a ceiling or the like and an attachment device of said fixture, wherein said fixture is provided with an electrical connection means and a mechanical stopping means, the electrical connection means including a power supply port that can be connected by a simple operation, and the mechanical stopping means capable of removably fixing a heavy and elongated fixture in the mounting hole, so that, when the fixture is mounted in the mounting hole, both electrical and mechanical connection is simultaneously done. By an integrated design of the fixture wherein the back of the mounting hole (a space behind the ceiling panel or the like) is used as a housing space for a lighting circuit member, etc., the fixture can be made more compact with an improved design flexibility, and changes and movements of fixtures with respect to the mounting hole become possible.

10 Claims, 27 Drawing Sheets

EQUIPMENT USING MOUNTING HOLE OF CEILING AS FIXING ELEMENT AND ACCESSORY DEVICES

This application is a division of pending application Ser. No. 08/849,672, filed Jun. 16, 1997.

TECHNICAL FILED

The present invention relates to a fixture and an attachment device to be mounted in a mounting hole in a ceiling, wherein a fixture of a recessed type or an exposed direct fitting type, such as a lamp casing, an alarm fixtures or the like can be selectively fitted as needed.

BACKGROUND ART

Here, the description is given centering around a downlight fixture, that is often used for shop lighting, as an example. The downlight employs a structure that an internally mirror-finished and wired housing is inserted and fixed to a mounting hole which is previously drilled in a ceiling panel and a light source bulb is fitted to the housing.

Since the drilled hole cannot be repositioned and cannot be diverted to purposes other than downlight fixtures, the entire ceiling panel has to be replaced with a new ceiling panel when the room is reformed after years.

In addition, for the insertion and fixing of the housing to the mounting hole, too, an apparatus formation to satisfy both the efficiency of fixing operation and the stability of fixing is indispensable.

As lighting becomes diversified and the interior technique has made progress, recent reforming, including the seasonal reforming of room interiors and lighting means suitable for individual types of displayed articles, is done now frequently.

As the result of diversification in lighting, in addition to conventional incandescent lamps, various types of light source bulbs have been developed, including energy saving, high efficiency and light-color-improved high luminance discharge tubes and fluorescent tubes (FDL), and various lighting circuit means and various shapes of housings and attachments that are applicable for these light sources are provided.

In designing an effect lighting, a light source to be adopted is set by simulation, taking into account the colors and reflection characteristic of interior media as well as the ceiling height of the construction site. Light representation, light source positioning and light source types are determined by taking the layout of articles and pieces of furniture into account.

Changes immediately before completion and rebuilding the ceiling surface in each reforming is quite inconvenient as it requires additional labor and costs and the closure of the shop during construction.

In shops, hotels and restaurants, legally obliged equipment such as smoke sensors, heat sensors, emergency lamps and speakers that are nonuniform in both color and shape are irregularly fitted to ceiling surfaces and make ceiling interior details ugly.

The object of the invention is to provide the fitting of various downlight fixtures with ease of adjustment immediately before completion and ease of changing in reforming. Namely, the first object is ease of fixing to and removal from the mounting hole and that solid fitting and stopping is possible, and further, that the mounting hole drilled in the ceiling surface can be jointly used for multiple purposes and functions, that the beauty as a facility can be maintained and that a permanent use of the ceiling facility can be made possible.

In the case of a conventional downlight fixture, it is inserted from underneath into the mounting hole drilled in the fitting surface beforehand and is held by a spring member that protrudes from the wall side of the fixture body and holds an edge of the mounting hole. As another hanging means, a means by which, after inserting the fixture into the mounting hole, stopping pieces provided on the wall sides of a fixture body are drawn down by inserting fingers inside the fixture (an inner space to mount a lamp) and are pressed against the hole edge, is employed.

However, by the hanging using the elasticity of said spring member, the thrust force to the mounting hole is limited and the engagement is unstable. In addition, it is not always possible to reuse the fixture after reforming the ceiling since the spring's elasticity is degraded by forced pulling. On the other hand, said stopping piece draw-down means has a drawback in that the attaching operation require a longer time compared with said spring process because an operation is necessary to be done inside the fixture and that when the fixture is mounted it is not possible to mount a light source bulb beforehand because the operation space has to be secured.

The diversification of fixtures and apparatuses during recent years is such that apparatuses such as sensors, monitor cameras and speakers, as well as luminaires, of the recessed type are commercialized, but because these apparatuses are relatively heavy, it is necessary to stably secure the mounting hole. For this reason, as hanging means that have an excellent stability of hang-fixing and do not require any in-fixture operation, proposed are a fitting device for a recessed type fixture disclosed in the Japanese Utility Model Publication No. 60-29782 and a fitting device for a recessed type luminaire disclosed in the U.S. Pat. No. 533,153.

In these fitting devices, a threaded shaft that is rotated by operation from outside the fixture keeps a function piece inside the fixture while inserting the fixture into a mounting hole, and after the insertion, extends the function piece toward a stopping zone, and then the fixture body is lowered so as to hold a mounting hole edge between the fixture and a flange.

According to the structure stated in the specifications of the above-mentioned publications, construction is complicated and the number of parts is large, and yet there is an anxiety about the sureness of operation. The second object of the present invention is to improve these points and provide a fitting device for recessed fixtures which is formed with a small number of parts and simple in construction, is easily fitted to and removed from a mounting holes, and assures sure and solid hanging.

Recently, there is a trend of reducing the height of individual floors in buildings. Accordingly, the ceiling space of each floor is narrowed, and needs for shallow type downlights as one of applicable means is increased.

By recent improvements, long-breadth light sources such as compact type fluorescent tubes and high-luminance discharge tubes are popularly used because of the energy saving effect and economy. These high-efficiency discharge tubes have structurally slender tubular bodies. When a light source with such a shape is applied to a shallow type downlight fixture, it is set laterally into the embedded body together with sockets.

In this case, a problem is the insertion to and removal from a socket of these light source tube/bulbs. That is, while stopping the long bulb laterally toward the socket which is set laterally in the narrow fixture body, the end base must be rotated while pressing the same against the prescribed position of the socket end, and yet a feeling operation at a height on a stepladder is troublesome as well as there is the danger of fingers touching the base or socket end.

Also, in the case of conventional shallow type downlight fixtures, the setting position for a light source tube/bulb is a little closer to a socket with regard to a reflector aperture of the main body, taking the insertion/removal space of the tube/bulb into account. As the result, the light center of the light source cannot be set for the center of reflected light axes of the reflector, causing degradation in reflection efficiency.

The applicant for the present invention previously proposed a downlight apparatus using an embedded housing. The apparatus using an embedded housing is structurally such that a tubular housing corresponding to the size of a lamp casing is previously fitted in a mounting hole in a ceiling or the like, and a downlight fixture body is held by the housing for use. Accordingly, if there is any projection exists on the lamp casing side, such as a lamp socket, engagement and insertion of the housing is not possible.

Since an operation to fit or replace a tubular bulb of the set downlight fixture is done near a ceiling surface using a stepladder with a wall switch turned off, it is necessary to move up and down the stepladder to access the wall switch each time to make sure of lighting. If this trouble is omitted or if a shop is open and there are customers, often the operation of replacing the tubular bulb is done with the wall switch on. In this case, there is the danger of electric shocks due to fingers touching electric parts as described above.

To solve the above-mentioned problems, the third object of the present invention is to provide a high-reflection, high-efficiency luminaire in which the main body of the luminaire can be engaged with an embedded housing by improving the shallow type downlight luminaire so as to enable the operation of replacing tubular bulbs to be done easily and safely.

In recent years, there are strong needs for the multipurpose use of spaces such as offices, workshops and houses using movable partitions. Multipurpose floor lighting is required to provide variations corresponding to different purposes of use.

Also, office equipment such as personal computers and word processors are widely used, and depending on the place where these apparatuses are put, the reflection and mirroring of lighting beams may occur in display screens, and thus the irradiating direction of light sources largely affects the health and work efficiency. Desirably, light sources can be moved according to the condition of use. Up until now, people and furniture have had to move around to cope with the fixed luminaires; it should have been the other way, around.

Furthermore, as a tendency, the reforming of window displays and shop displays are done frequently, and in this case, too, the movement of lighting apparatuses is required.

In the case of conventional luminaires, changes in fitting positions on ceilings and walls were done using lighting ducts, so that the movement was limited to be along such lighting ducts.

The fourth object of the present invention is to provide a luminaire of which the position and orientation can be changed to meet the above-mentioned requirements.

For fixtures fitted to ceilings, such as sensors and monitor cameras, the recessed type like a downlight luminaire is also adopted in addition to those directly fitted to ceilings.

These fixtures typically employ conventional fixtures that are directly embedded and held. As described in the prior art, however, there is also a method using embedded housings, which has an advantage that fixtures can be optionally selected and changed as needed.

The above-mentioned fitting methods are based on a precondition that the fitting surface is a double-ceiling. Today, there are many facilities that have reinforced floors and slab ceilings, and said fixtures for double-ceilings are not applicable to these facilities.

To solve this problem, the fifth object of the present invention is to provide an exposed casing for slab fitting.

A double-ceiling provided at the ceiling surface of a slab is a thin ceiling panel for decoration. So far, embedded fixtures have been limited to light-weight fixtures, taking the strength of the double-ceiling into consideration.

Recent diversification in luminaires has resulted in development of recessed-type fixtures using light sources such as multi-tube fluorescent lamps or high-luminance mercury lamps. These fixtures need stabilizers or transformers for the lighting circuits. Fitting these integrated-type fixtures to double-ceilings contains an anxiety due to the strength. In addition, a rotatable fixture dealt in the present invention has an elongated structure if it is a compact fluorescent lamp (FPL) or the like. A heavy, elongated lamp cannot be fitted to a double-ceiling which does not have sufficient strength, because there is the danger of an external force being applied to an end of the elongated lamp, which may apply an unreasonable force to the edge of the mounting hole in the ceiling.

To solve this problem is the sixth object of the present invention.

Basic concept of the present invention is summarized in the following:

The title of application for the present invention is "EQUIPMENT USING MOUNTING HOLE OF CEILING AS FIXING ELEMENT AND ACCESSORY DEVICES".

The prescribed mounting hole in a ceiling space in which various fixtures are mounted is merely referred to as a "mounting hole" hereinafter.

The fixture may be wiring accessories, a luminaire or any one of various functional apparatuses attached to a ceiling of a residential space and is merely referred to as a "fixture" hereinafter.

(1) The "mounting hole" is internally equipped with general-purpose power supply (strong and weak electric power) and control functions.

(2) The "mounting hole" internally forms a mechanical stopping mechanism for a fixture.

(3) A fixture wherein mechanisms specified in Paragraph (1) (electrical) and Paragraph (2) (mechanical) described above are simultaneously connected by a touch-operation is also proposed (a unit body described in paragraph (6) mentioned later).

(4) The "mounting hole" space forms a housing space for externally inserting and fitting an integrated "fixture" in whole or in part. Specifically, an embedded housing is used.

Installation has to be conducted externally and from one direction only into the "mounting hole" according to construction procedures.

a: Examples of complete housing

Downlight fixtures, smoke sensors (these may be directly attached), etc.

b: Examples of partial housing

Component parts of semi-recessed, direct fitting type luminaires (lighting circuit members, transformers, reelers, suspension devices, extension devices, etc.)

(5) The invention is characterized in that structures of the above paragraphs (1), (2), (3) and (4) are integrated, depending on the function and usage of each fixture and are installed in "mounting holes."

(6) The "fixture" is available with two types; a single body and a unit body that uses an embedded housing in between, which are used for the same space but for different purposes [single body→fixed usage, low cost; unit body→variable by touch-operation, movable, and available for floor operation (lamp changes, reflector cleaning, etc.)].

Further, for use with a downlight unit, for example, both the single body and the unit body are produced by using a common die, dividable, and are given the low-cost performance and additional functions.

(7) By the integrating effect, choice and combination of the above, multiplying/expanding effects are attained in design performance, additional function and economy.

(8) When the unit body is used, since the completion inspection is finished simply by installing an embedded housing, it is possible to choose a "fixture" on the site after deciding a resident/tenant. Hence, wasted fixture and losses in installation work due to changes can be eliminated, and yet the same effect can be obtained each time the status quo ante is restored when a tenancy is canceled/expired.

(9) In space production and effect lighting in a shopping center or the like, a totally uniform design can be intended in terms of light source, light distribution, usage and wiring systems by providing fixture edges with the same design (in shape and color) and the same diameter on ceiling surfaces.

(10) In addition to the above-mentioned paragraph (9), when unit bodies are used in a commercial space (sales corner, show window) where layout changes and renewals in floor units are frequent, changing "fixtures" can be done flexibly with touch-operations even by shop clerks who do not have a qualification to do electrical work. That is, the effect of changing the fixture configuration is noticeably increased. It is particularly effective when tenants change (example: recessed-type downlight→direct-fitting fixture→pendant fixture).

(11) For example, by the recent development of energy saving compact type fluorescent lamps (FDL) and the resultant commercialization of fixtures for 27 W (corresponding to a 100 W incandescent lamp) and 32 W (150 W), downlight fixtures that were formerly used for local lighting are rapidly shifting toward base lighting (whole lighting). In this case, a round-hole preparation of "mounting holes" can be done most speedily and at low costs by using popular electric tools. A new stopping mechanism for speedy mounting to a mounting hole is also provided by the invention.

(12) Unit body type embedded housings allow unnecessary lamps to be removed and can be closed by applying flat covers without the need for selectively turning off some of lights. This means that adjustments in luminance and light distribution in changing layout can be done separately from changing light sources and lamp casings. In other words, together with the changing function, this contributes to the development in double-ceiling preparation, prefabrication and modularization (resulting in cost reduction and a reduction in construction period).

(13) In the past, the light source use for a downlight fixture was an incandescent lamp. As the base was commonly available for 40 W, 60 W and 100 W lamps, luminance changes were done merely by changing lamps and even unskilled persons could do it.

However, in the case of the recently mainstream compact type fluorescent lamps (FDL), bases differ by lamp wattage because lamps are each to be made in a set with an applicable lighting circuit.

Because of this, in changing luminance, an entire fluorescent downlight fixture is to be removed from a double-ceiling, which requires a specialist engineer and increases costs a lot. The same can be said to changing a light source.

The unit type (embedded housing) solves this problem, too.

(14) The present invention also eliminates causes of rust and salt-induced corrosion by using plastics for the downlight fixtures that have conventionally been made of metal parts. Further, together with an effect that an integrated use of a ceiling space and a fixture is first made available by incorporating a new stopping mechanism into the "mounting hole" which enables several ten times of removals and fittings, the present invention specifically intends a semi-permanent use.

Accordingly, an everlasting use through which no recycling is necessary is possible and energy saving and ecological requirements are satisfied. (Currently, metallic downlights are discarded each time the double-ceilings are replaced or after replacing them several times at the most, though reasons are not mentioned here.)

(15) In addition to the advantages of common dies and divisibility stated in said Item (6), using plastics affords the following advantages:

a: As plastic is an insulator, it allows housings of terminal blocks and so on to be integrated into lamp casings, resulting in a cost reduction.

b: An optimal curve for luminous efficiency and a stepped portion can be integrally and simultaneously formed on the reflector surface.

c: With regard to the reflector, in addition to a mirror finish, it can be finished in white for use with compact type fluorescent lams (FDL), and thereby effects, such as erasing the lamp image and eliminating glare, can be secured.

d: By compounding an after-light coating material with resin, a use as an emergency lamp which requires no power supply can be obtained.

DISCLOSURE OF THE INVENTION

Therefore, in the present invention, the lamp casing of a downlight luminaire, for example, has a bullet-shaped outline, and the periphery of the lamp casing base is equipped with a flange that comes into contact with the edge of the front face of said hole. Also, this base is equipped with lamp casing stopping mechanisms each having a projected piece that is housed inside when the lamp casing is inserted into or removed from the mounting hole and pulled up outside when the lamp casing is secured in the mounting hole. Each projected piece is housed and pulled up by a tool that is operated through a hole piercing said flange. The invention proposes two manners of using a mounting hole: direct fitting of a lamp casing (fixed, low-cost usage) and using an embedded housing mounted beforehand is used as the mounting hole so as to facilitate selection and changes of lamp casings and/or other fixtures to be fitted in the mounting hole (changeable usage). This housing is tubular in shape, and is equipped with a simultaneous mechanical and electrical connection means to insert a lamp casing or other fixtures from the open end. The housing has housing stopping mechanisms that are similar to the lamp casing stopping mechanisms having said projected pieces at a part of its outer wall.

In particular, a sensor is provided to make sure that electric connection is effected only when proper engagement of a lamp casing in the housing is ascertained.

As other fixtures, various fixtures are applicable, including monitor cameras, speakers, electronic display boards and luminaires of other types. However, as an example of luminaire, the invention proposes a fixture having a simple structure that consists of a wiring incorporated column, a light source and a cable movably arranged on the ceiling surface, and bulky members including a lighting circuit member housed in the mounting hole (in the ceiling space), wherein the orientation of the light can be changed as desired.

Also, by regarding the above-described mounting hole provided in a broad sense, in other words by providing a unique structure of a mounting hole itself, any one of said lamp casings and other fixtures can be used with reinforcing bars or a slab that do not have any double-ceiling in the same manner as above. More precisely, there is provided a tubular body to be embedded in a ceiling, the tubular body having a brim with an inside diameter corresponding to the diameter of the mounting hole. The tubular body is formed so that a fixing means to an installation place is provided at one end of the tubular body and that a ceiling embedded type fixture is inserted and held from the other end of the tubular body.

If the strength of a thin double-ceiling in which the mounting hole is provided is insufficient for supporting the fixture, a high load torque moment support device for the fixture is provided between the double-ceiling and the slab.

The support device is directly or indirectly supported by the slab at the upper end of the device holds at the bottom thereof the fixture inserted into the mounting hole. As a means provided at the bottom end of the device in order to catch the fixture, either the bottom end is formed as an extended edge extending along the back face of the, and the extended edge located between the back surface of the double-ceiling and a stopping mechanism for fixing the fixture to the ceiling, or, a base plate of the fixture is supported by a column of the device piercing through the fixture that has been inserted into the mounting hole.

BEST MODE FOR CARRYING OUR THE INVENTION

The configuration of embodiments of a fixture according to the present invention is described in the following by referring to the attached drawings.

Figure 1:
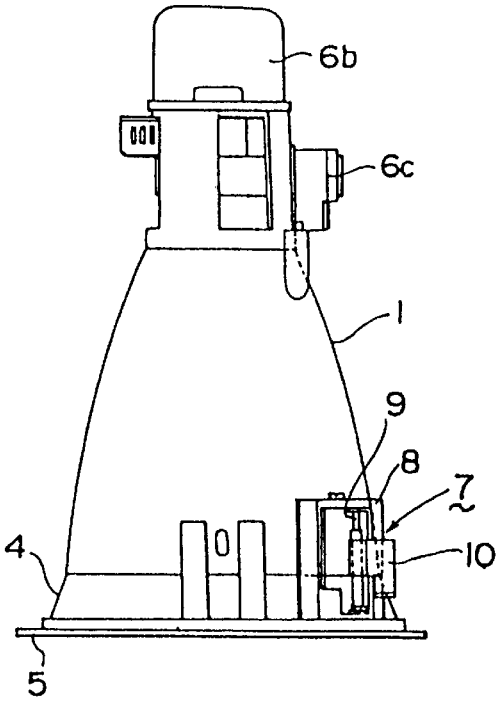
FIG. 1 is a side view showing an embodiment of a fixture according to the present invention.
Figure 2:
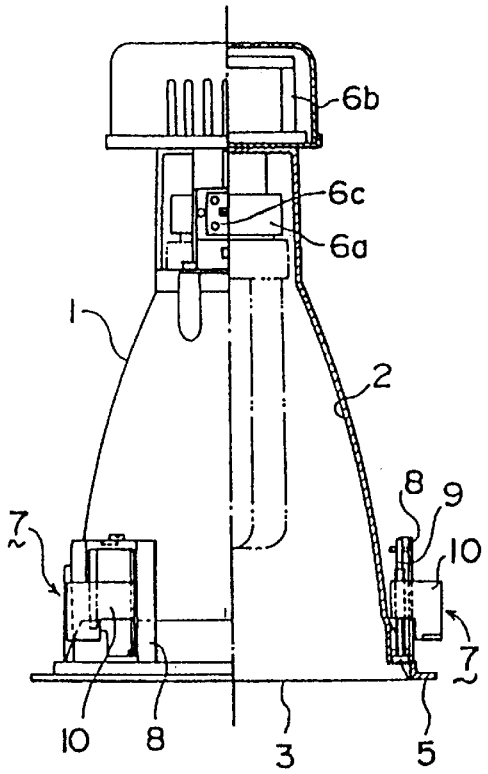
FIG. 2 is a partially cut out side view of the same viewed from another side.
Figure 3:
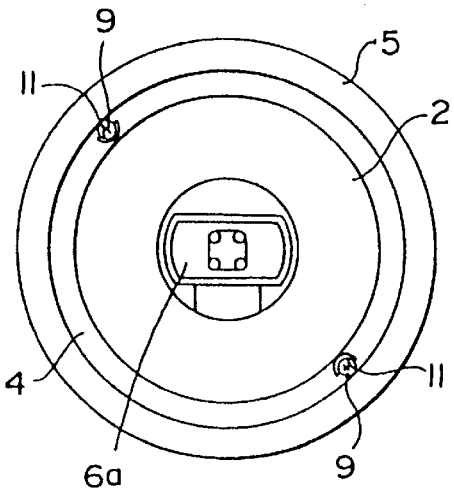
FIG. 3 is a bottom view of the same.

FIG. 1 is a side view showing a downlight lamp casing as an example of a fixture; FIG. 2 is a half-cut vertical sectional view showing another side of the same lamp casing; and FIG. 3 is a bottom view of the same. In these figures, a lamp casing 1 is a casing having a generally bullet-shaped outline, an internal major part is formed as a light reflecting surface 2, the bottom end of the lamp casing 1 is an open end 3, a base 4 is formed at an external sloped part of the open end 3, and a flange 5 that comes into contact with a mounting hole in a ceiling is provided around the outer edge of the base 4.

The lamp casing 1 has at the upper portion thereof a lamp socket 6*a* and, if necessary, a lighting circuit member 6*b* such as a stabilizer, and also a wiring means 6*c* for connection to a power source.

A reference numeral 7 denotes a lamp casing stopping mechanism, which is arranged symmetrically at two locations of said base 4, and each lamp casing stopping mechanism 7 is designed such that one end of a projected piece 10 is screw-fitted to a threaded shaft 9, that is attached to a square support frame 8 and is allowed to rotate freely, and the projected piece 10 moves along the threaded shaft 9 accordingly as the threaded shaft 9 rotates.

The other end of each projected piece 10 is a free end and swings about ¼ turn at the initial rotation of said threaded shaft 9, but a part of the projected piece 10 comes into contact with the support frame 8 at a point beyond this swinging zone and prevents further rotation. And, each projected piece 10 is formed flat so that it does not protrude from a frame while it is housed inside the support frame 8 and is shaped with a curve along an outer wall of the lamp casing 1.

When each lamp casing stopping mechanism 7 is assembled to the lamp casing 1, the support frame 8, to which said threaded shaft 9 and said projected piece 10 are previously fitted, is screwed or otherwise fastened to a prescribed position of said base 4.

To enable said threaded shaft 9 to rotate, a piercing hole 11 is drilled through the base 4 of the lamp casing 1, with which the lamp casing stopping mechanism 7 is assembled, at a point extending from the shaft end of the threaded shaft 9 so that a tool can reach the shaft end of the threaded shaft 9 through this piercing hole 11.

Figure 4:
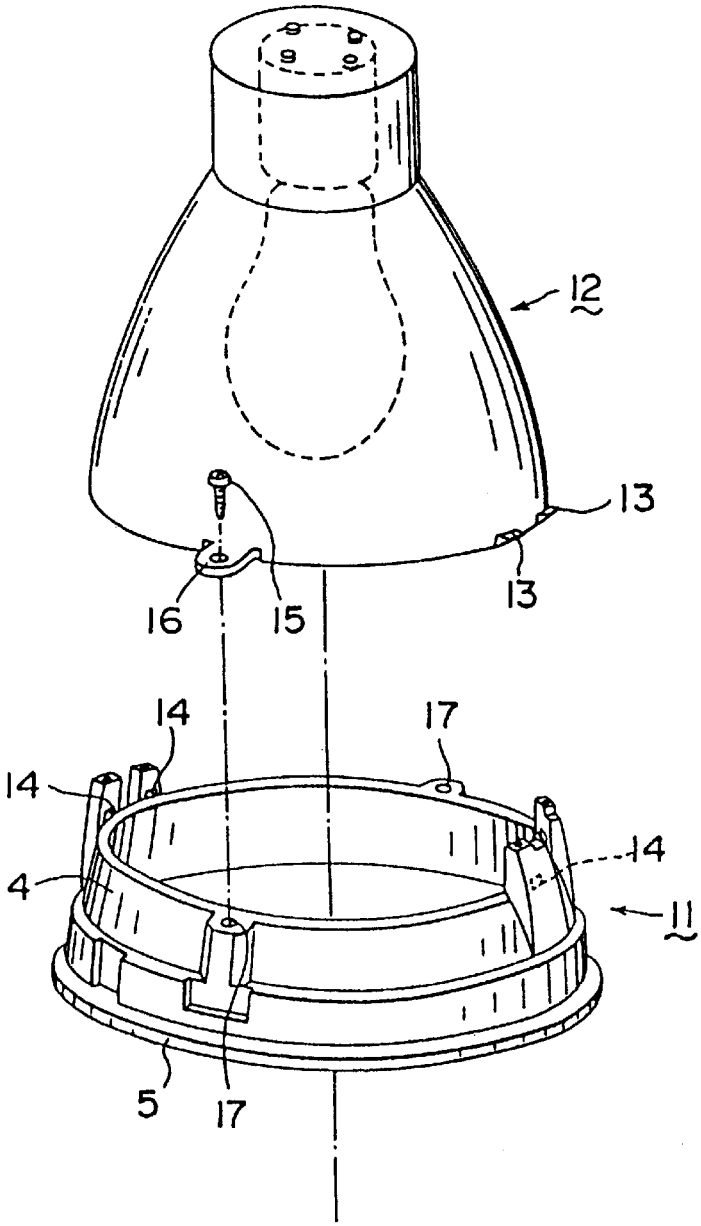
FIG. 4 is an exploded perspective view showing another embodiment of the fixture according to the present invention.

FIG. 4 is an exploded perspective view showing another structure of a lamp casing, in which the lamp casing 1 is formed as an assembly of a base 11 containing said base 4 and the flange 5, and a lamp casing body 12 formed with the remaining parts of the lamp casing 1, mainly said bullet-shaped outline unit. Additionally in this case, when several types of lamp casing bodies and bases are prepared with different shapes in conjunction with a progressive fixture mentioned later, it is possible to obtain several types of the lamp casings 1 by properly combining these lamp casing bodies and bases.

Figure 5:
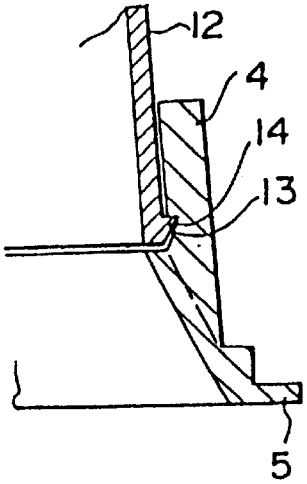
FIG. 5 is a sectional side elevation showing an enlargement of an essential part of the embodiment of the fixture according to the present invention.

To assemble these lamp casing body 12 and base 11, engaging claws 13 are provided at a plurality of locations around the circumference of the bottom end joint surface of the lamp casing body 12, while engaging slits 14, respectively corresponding to said engaging claws 13, are provided around the top joint surface of the base 11, so that, when the lamp casing body 12 and the base 11 are joined, engaging claws 13 are caught in engaging slits 14 to secure the lamp casing body 12 and the base 11 joined as shown in FIG. 5. Further, to enhance this joining condition, screw hole lugs 16 are provided to protrude outside the joint surface of the lamp casing body 12, and screw columns 17 are provided at positions opposing to said screw lugs 16 around the base 11 so as to drive screws 15 into screw columns 17 through screw holes. However, so far as the joining condition by said engaging claws 13 is sufficient in strength, this joining means using screws 15 is not always required.

In this case, to cope with said lamp casing body 12 that is molded with a nearly uniform thickness, the base 11 has partially thick portions for attaching electrode terminals or stopping means. Also, the base 11 may be formed as an integral body by laterally arranging a plurality of tubular-shaped single bodies described above. It is also possible to form the lamp casing body 12 and the base 11 with different molding materials such that said lamp casing body 12 is made of a heat resistant resin and the base 11 is prepared with another molding material having a better mechanical strength.

Figure 6:
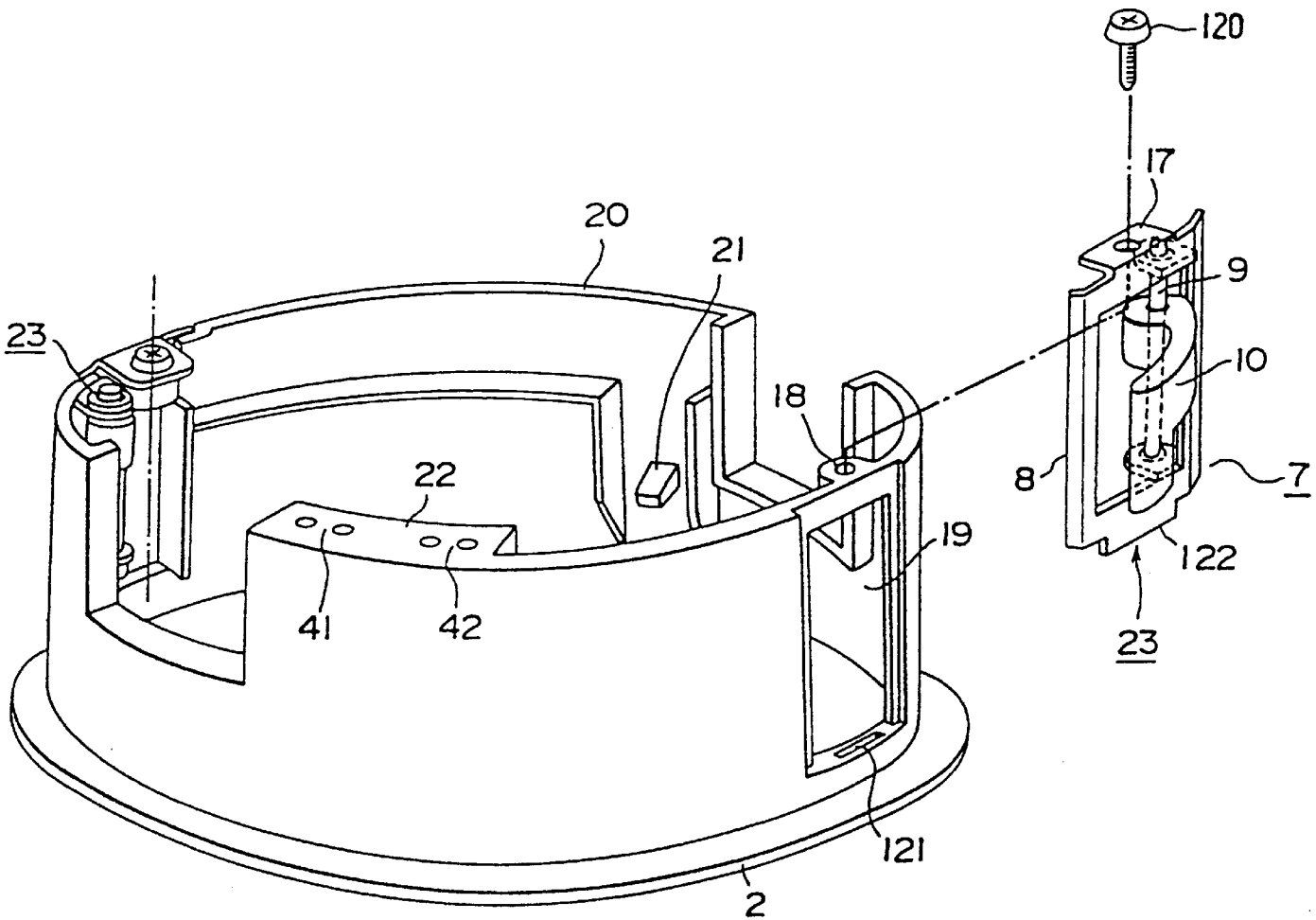
FIG. 6 is a partially exploded perspective view showing another embodiment of the fixture according to the present invention.

FIG. 6 is a perspective view showing, as an example, an embedded housing separated from the fixture according to the present invention. In the figure, a reference numeral 20 is a tubular housing made of a metal or a synthetic resin and is formed to be inserted from under into a mounting hole opened in a ceiling so that a flange 2, provided around the bottom end circumference in the same way as said lamp casing 1, comes into contact with the edge of the front face of the mounting hole. Open slits 19 are formed in a part (at two or more locations) of the tubular wall of the housing 20, stopping mechanisms 7, having the same structure as that of stopping mechanisms 7 of said lamp casing 1 are disposed in the respective slits 19, and the housing 20 is fastened to the mounting hole with the edge of the mounting hole sandwiched between projected pieces 10 of the stopping mechanisms 7 and said flange 2.

At the other parts of the housing 20, an operating projection 21 for catching the lamp casing to be mounted in the housing 20 (see FIG. 7 and FIG. 8) and a connector mechanism 22 for effecting electrical connection are provided.

Figure 7:
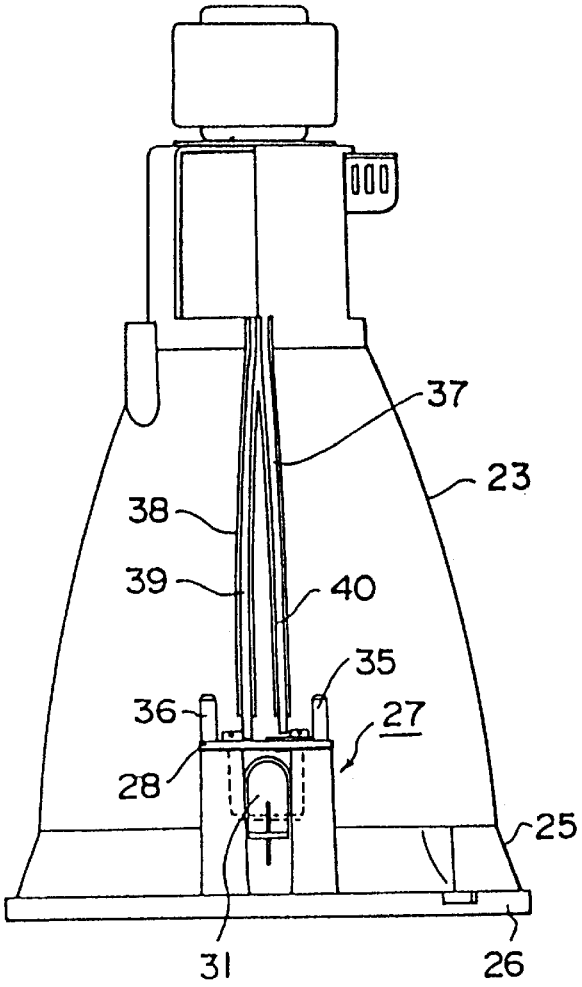
FIG. 7 is a side view showing still another embodiment of the fixture according to the present invention.
Figure 8:
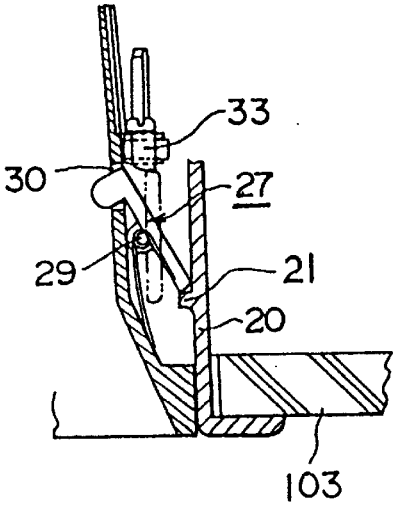
FIG. 8 is a sectional side elevation showing an enlargement of an essential part of the fixture according to the present invention.
Figure 9:
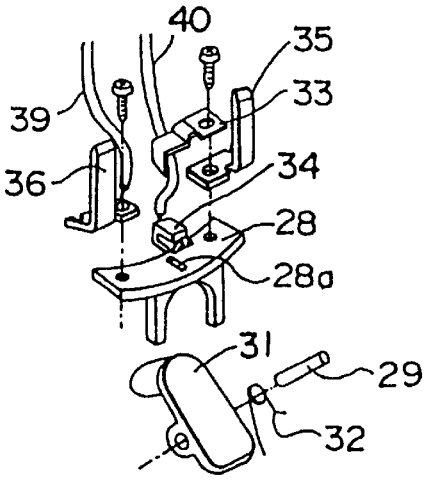
FIG. 9 is an exploded perspective view showing an essential part of the fixture according to the present invention.

FIG. 7 is a side view showing a lamp casing as a fixture to be mounted in the embedded housing 20, which is formed with a hollow lamp casing 23 having a generally bullet-shaped outline and basically the same construction as the lamp casing 1 of said FIG. 1, and in particular, the lower portion leading to said outline of the lamp casing 23 is formed with a base 25 that is formed as an inclined outer wall and an engaging edge 26 that agrees with an inner peripheral wall of said housing 20. Utilizing a gap between the base 25 and the engaging edge 26 that is formed when the lamp casing 23 is fitted to the housing 20, a sensor 27 is provided on the outer wall of the lamp casing 23. The sensor 27 is, as shown in FIG. 8 that is a sectional fragmentary side elevation and FIG. 9 that is an exploded perspective view of an essential part, has a stopping lever 31, with its upper end facing a small hole 30 opened in the lamp casing wall, the stopping lever 31 attached to a shaft 29 and capable of rotating under an action of a spring 32 that gives the lever counterclockwise rotation as viewed in FIG. 8, the shaft 29 supported by a bearing block 28 that is formed integrally on the outer wall of the lamp casing 23 and is made of an electrical insulator. In a zone where said upper end of the stopping lever 31 swings against a given spring force, a switch-movable piece 33 is provided through a piercing hole 28*a* opened in a crest of said bearing block 28, and a switch terminal board 34 is placed between the movable piece 33 and the bearing block 28 so that said movable piece 33 fixed together with a plug blade 35 to another position of the block 28 is formed so as to open one electrode circuit of a power supply circuit by touching the switch terminal board 34 under its normal condition given by an elastic force of its material, and when the movable piece 33 is thrust to said lever 31, leaves the terminal board 34 and opens the circuit. A plug blade 36 that forms another electrode circuit is a single-sided power supply circuit comprising a normally closed circuit.

When the lamp casing 23 is mounted in said housing 20, these plug blades 35 and 36 of both poles invade into said connector mechanism 22 of the housing 20 in a final zone of this inserting operation for mounting to electrically connect them. However, since the stopping lever 31 is pressed and rotated clockwise in FIG. 3 against a spring force given by the spring 32 by the lower end of said lever 31 that slides along the inner wall of the housing 20 during this inserting operation of the lamp casing, said electrode circuit is kept opened.

Simultaneously with a mechanical stopping operation that the lower end of the stopping lever rides over the operating projection 21 of the housing 20 in the final zone of inserting operation by spring force and then reaches a stop position shown in FIG. 8, the upper end of the lever 31 is released of a thrust-up condition by the lever 31, returns downward by an elasticity of its material, and as described above, closes the one electrode circuit.

Since a light source tube/bulb fitted to the lamp casing 23 is lit by this switching operation, an operator can learn that a mechanical stopping and an electrical connection of the lamp casing 23 to the housing 20 are done.

Plug blades 35 and 36 of the sensor 27 located at the lower portion of the lamp casing 23 and a lamp socket located at the upper portion of the lamp casing 23 are connected with wires 39 and 40. These wires 39 and 40 are embedded respectively in U-grooves 37 and 38 that are formed along the bullet-shaped outer wall. The bottom of the connector mechanism 22 of the embedded housing 20 is in the shape of a plug socket to receive plug blades 35 and 36 that invade from under into the housing 20, the top of the connector mechanism 22 is formed in the plug socket, with an indoor wire intake 41 and a lead wire intake 42 arranged along the tubular peripheral wall.

And the connector mechanism 22 is formed integrally with the tubular outer wall of an insulating synthetic resin in a gap between an inside of the tubular peripheral wall of the housing 20 and the outer wall of the lamp casing 23 to be inserted. Accordingly, the power supply wire and the lead wire connected to the connector mechanism 22 are arranged in parallel along the peripheral wall of the housing 20 and at heights inserted to intakes 41 and 42 respectively.

Figure 10:
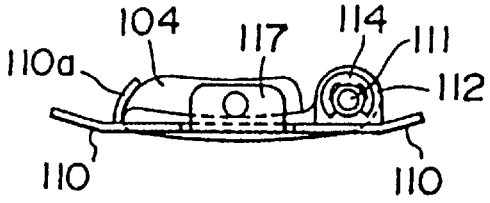
FIG. 10 is a plan view of a device according to the present invention.
Figure 11:
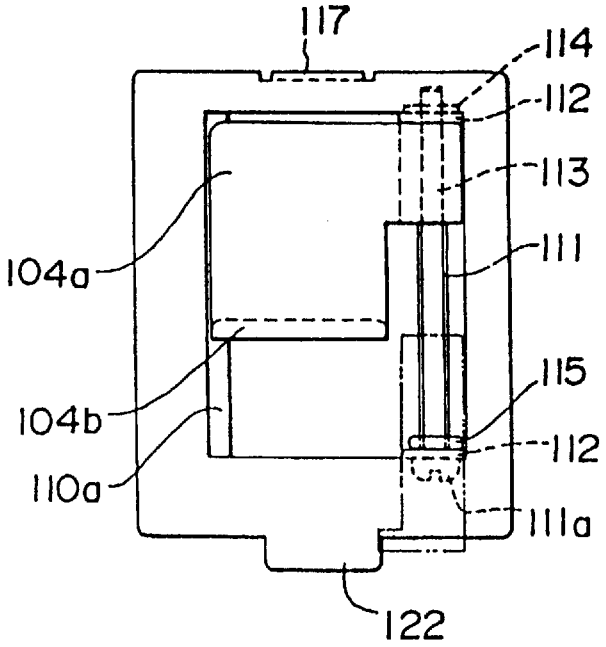
FIG. 11 is the front view of the same.
Figure 12:
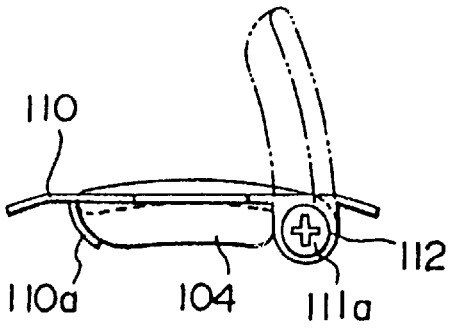
FIG. 12 is a bottom view of the same.

Next, a specific structure of a stopping mechanism arranged in said lamp casing 1 and housing 20 is described, referring to a plan view of FIG. 10, a side view of FIG. 11 and a bottom view of FIG. 12. Lugs 112, facing the same direction, are cut and lifted at the upper and lower edges of a support frame 110 that is mounted in the open slits 19 of said lamp casing 1 or the housing 20, and one end of a projected piece 104 is screwed to lugs 112 and a rotatable threaded shaft 111 that is passed through the lug 112. And, the projected piece 104 is a molded body of synthetic resin having a projected portion 104*a*, and the free end of the projected piece 104 is formed as a stepped portion 104*b* vertically extended from the aforementioned screwed position.

The threaded shaft 111 is capable of rotating and has a shaft head 111*a* at the lower end passing through the lug 112, and at the shaft end passing through the upper lug 112, with a washer 114 attached to the shaft end, thereby preventing the shaft 111 from slipping off from the lugs 112. In particular, the upper portion of the shaft where said projected piece 104 is screwed (the part which said one end occupies when the projected piece 104 fitted around the shaft 111 is at the topmost position) is formed as an unthreaded rod portion 113. Also, a rubber ring 115 is fitted around the threaded shaft 111 at the bearing part where the lower lug 112 is supported to generate a frictional resistance between the lug 112 and the threaded shaft 111, thereby preventing an inadvertent rotation of the threaded shaft 111.

In addition, a reference numeral 110*a* represents a stopper, which is provided inside said support frame 110 within a swinging zone of the free end of the projected piece 104 so as to keep a swing of the projected piece 104 up to a contact point with the stopper 110*a* (a prescribed point of the projected piece 104 within the frame), and a reference numeral 122 represents an insertion projection provided at the lower end of the support frame 110, which is formed such that, when the support frame 110 is mounted in said housing 20, the insertion projection is inserted into an engaging hole 121 provided at the lower edge of the open slit 19, and at the same time a screw 120 is driven through a screw hole of a brim 117 provided at the upper edge of the support frame 110 into the upper edge screw hole 18 of the open slit 19.

Each stopping mechanism structured as above is such that, when it is mounted in the housing 20, for example, the free end of the projected piece 104 is at the prescribed position and touches the stopper 110*a*, as illustrated by solid lines in FIGS. 10, 11 and 12. Under this condition, the housing 20 can be inserted smoothly into the mounting hole, and after the insertion, by turning with a screw driver the shaft head 111*a* of the threaded shaft 111 that faces the inside of the peripheral wall of the housing 20, the threaded end located at the unthreaded rod portion 113 in the beginning is gravitationally screwed with the threaded shaft 111, so that, as shown in FIG. 12, a counterclockwise rotational force works to the projected piece 104 and thereby the projected piece 104 rotates together with the threaded shaft 111 until the projected portion 104*a* stops at the edge of the support frame 110 (illustrated with chain lines in the same figure), thereby stopping the swing of the projected piece 104.

If the threaded shaft 111 is operated to rotate continuously in the state where said swinging action is stopped, the projected piece 104 gradually descends along the frame, and the lower end of the stepped portion 104*b* comes into contact with the mounting hole edge to fix the housing 20 to the mounting hole with the edge of the mounting hole held between the flange 2 of the housing 20 and the stepped portion 104*b*. At that time, even if the mounting hole edge is thinner than the lower frame of each open slit 19 of the housing 20 and the lower edge of the support frame 110, the edge of the hole can be held because the projected piece 104 faces the edge of the hole in the state where the lower end of the stepped portion 104*b* vertically extending downward from the screwed end is at a low position.

When said threaded shaft 111 is rotated in the reverse direction from the holding position where the shaft 111 has been moved by the descent of the projected piece 104, the projected piece 104 rises and rotates together with the shaft 111 in the state where the free end is removed from the mounting hole edge, and swings until the free end stops at the stopper 110*a*. Thereafter, the projected piece 104 rises along the stopper 110*a* accordingly as the threaded shaft 111 is rotated.

This rising operation, effected by an electric screw driver, stops when the projected piece 104 reaches the top position (a position shown in FIG. 11) and in a unscrewing zone where the screwed end slides toward the rod portion 113 of the shaft 111. As the threaded shaft 111 idly rotates thereafter, there is no need to adjust a shaft rotation by a screw driver or other means in order to stop an unreasonable rising movement of the projected piece 104. Therefore, the housing 20 can easily be removed from the mounting hole without the danger of damaging components.

Figure 13:
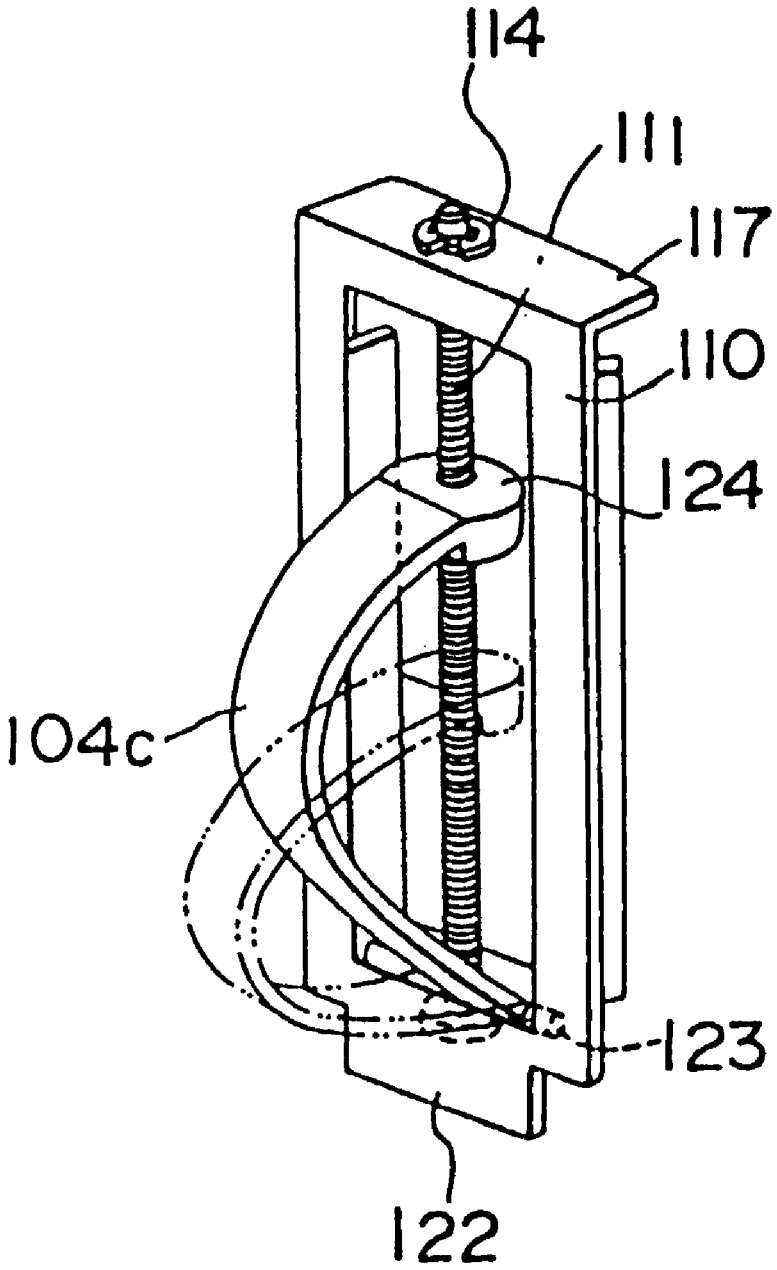
FIG. 13 is a perspective view of another embodiment of the device according to the present invention.

FIG. 13 is a perspective view showing another embodiment of the stopping mechanism. Instead of the projected piece 104 having said vertically extending stepped portion 104*b*, each mechanism includes a spring plate 104*c* of which the lower end is supported by a shaft-support 123 and the upper end is screwed around the threaded shaft 111. The remaining structure is the same as the aforementioned embodiment.

Figure 14:
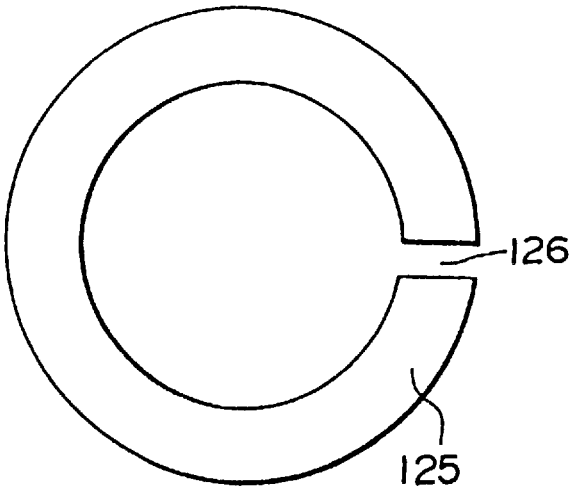
FIG. 14 is a plan view showing a reinforcement ring used with said device.
Figure 15:
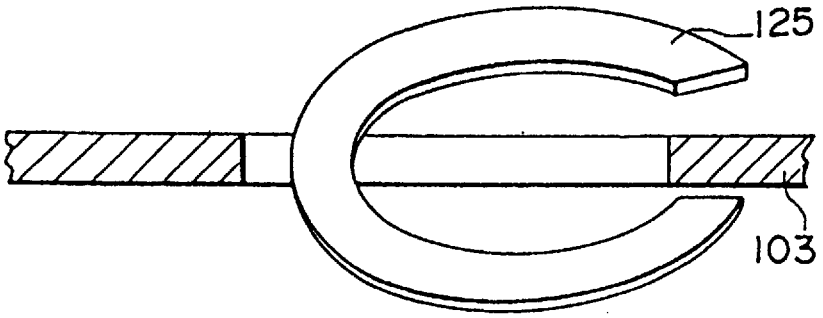
FIG. 15 is a perspective view showing the setting procedure of said reinforcement ring.
Figure 16:
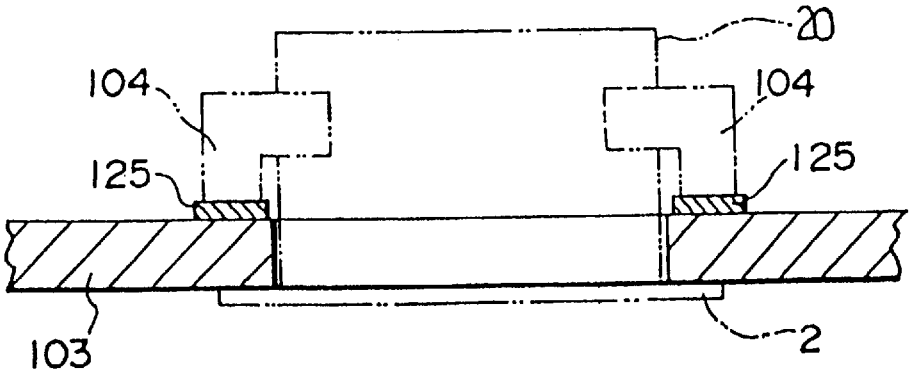
FIG. 16 is a sectional side elevation showing said reinforcement ring when it is set.

According to the above structure, the upper end 124 is lowered by rotating the threaded shaft 111, and the spring plate 104*c* is markedly curved as illustrated with chain lines in FIG. 13. The curved spring 104*c* holds the mounting hole edge at its loop. This is effective when a ceiling panel, in other words the mounting hole edge, is thick enough. Meantime, in cases where the ceiling panel 103 is a weak decorative ceiling, there is the strong possibility of the edge of the projected piece 104 abutting against the mounting hole breaking the thin hole edge even though it is possible to hold the mounting hole edge with the stopping mechanisms of the aforementioned embodiment. Therefore, a reinforcement ring 125, shown in FIG. 14, is used in this case. More precisely, the reinforcement ring 125 is a ring made of a metal or a hard plastic material and has an inside diameter virtually equal to the mounting hole diameter, and a separation slit 126 is provided at a point. By enlarging the separation slit 126 by utilizing an elasticity of the material, the mounting hole edge is slid into the separation slit 126 (FIG. 15), the reinforcement ring 125 is passed through the mounting hole by way of the separation slit 126 and put on the edge of the back face of the mounting hole as shown in FIG. 16, and then said projected piece 104 is thrust to the reinforcement ring in the same manner as said embodiment. Thereby, a breakage of the mounting hole edge can be prevented.

Figure 17:
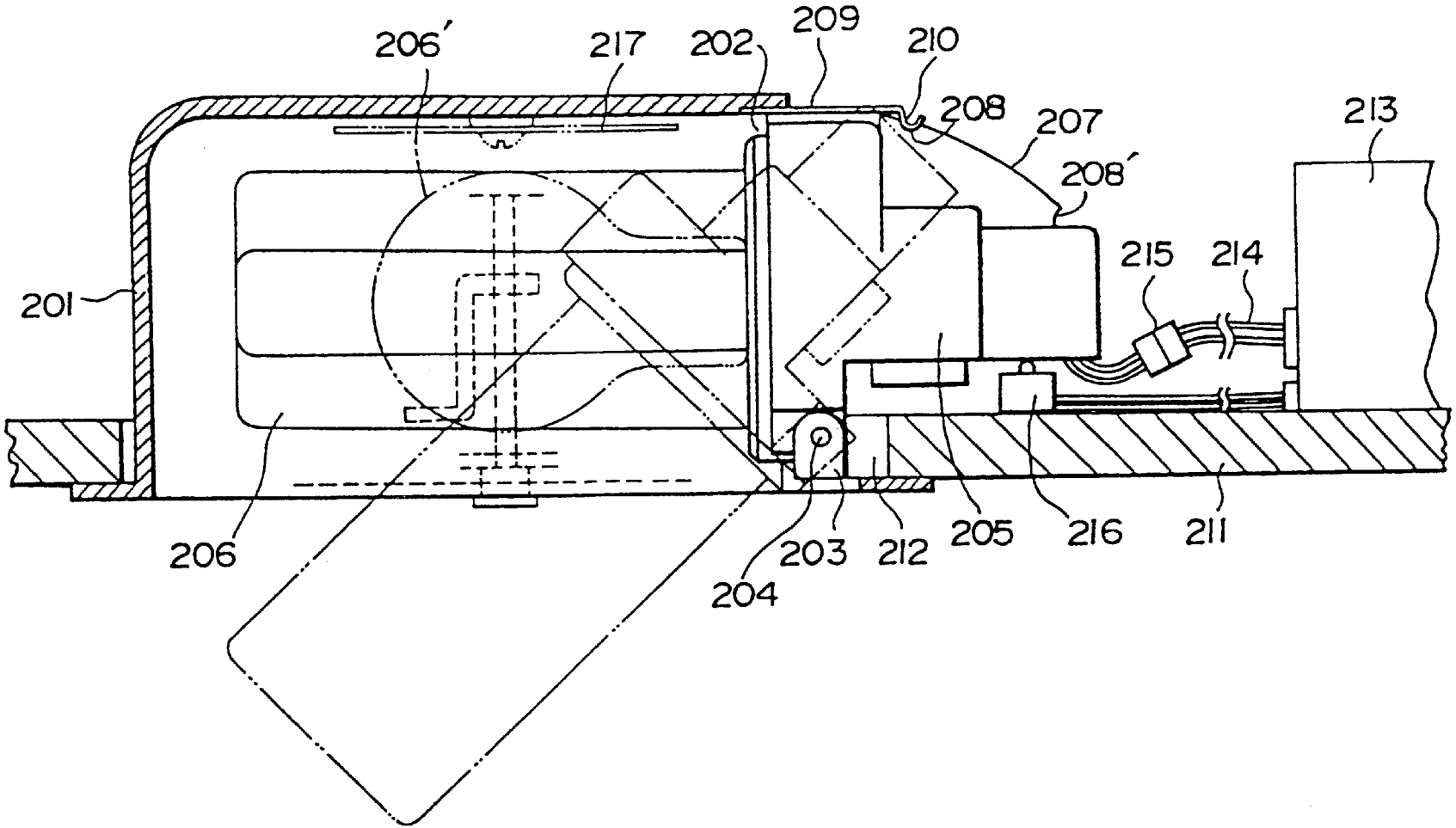
FIG. 17 is a partially cut out side view showing an embodiment of the fixture according to the present invention.

FIG. 17 is a partially cut out side view showing another embodiment of the fixture according to the present invention. By opening one side wall of an embedded body 201, whose inner surface finished as a light reflecting surface, an open window 202 is provided, and support pieces 203 and 203 are formed by partly cutting both sides of the lower edge of said open window 202 and a lamp socket 205 supported by a support shaft 204 is so attached to the support pieces 203 as to be capable of swinging around said shaft 204. As illustrated with solid lines in the figure, the most part of the lamp socket 205 is protruded from said open window 202 to the outside of the body 201 when in use, with a discharge tube/bulb 206 or an incandescent lamp 206' mounted in the socket 205 that is disposed horizontally in the body.

The position of lamp socket 205 when in use is maintained by thrusting a holding projection 210 of an elastic piece 209 projected by its elastic force from the body 201 to hold a stopping slit 208 of a cam surface 207 that is integrally provided with the lamp socket 205, and, a holding slit 208' as a holding slit for said holding projection 210 at a socket pull-out position to be described later is provided at another position of said cam surface 207.

In addition, a reference numeral 211 is a ceiling panel, in which the body 201 is fixed (by a fixture illustrated with dotted lines in the figure) to a mounting hole 212 by inserting it from underside (the right hand side in the figure), and a power cord 214 extended from a lighting circuit member 213 such as a stabilizer located behind said ceiling panel 211 is connected to the lamp socket 205 by way of a well-known push-in connector 215. A reference numeral 216 is a push type safety switch, which is included in a power supply circuit for said lighting circuit member 213 and is located behind the ceiling, at a position where it is pushed by a part of the socket outer wall so as to close the circuit (to supply power) when the lamp socket 205 is in use.

A reference numeral 217 is a heat shielding board and is fixed to a position directly above the incandescent lamp 206' inside the body 201. Thus, the lamp socket 205 rotatably attached to the body 201 by said support shaft 204 is capable of swinging towards the position indicated with chain lines in the figure by holding and pulling firmly the mounted discharge tube/bulb 206 or incandescent lamp 206', the position of which is given with solid lines in the figure, so as to push out the holding projection 210 from the holding slit 208 along the cam surface 207 and further, it can be swung by approximately 90° to the position in which it faces vertically downward, where said holding projection 210 engages with the other holding slit 208'. As a result, the mounted discharge tube/bulb 206 or incandescent lamp 206' protrudes below the body 201 and it can be replaced or undergo checking. At that time, a power cord 214 from a lighting circuit member 213 is extended without being stretched and the connector 215 remains connected, but since the push switch 216 is released from the pressure by the outer wall of the lamp socket 205 and is under an open circuit condition, power supply to said socket is cut off.

Figure 18:
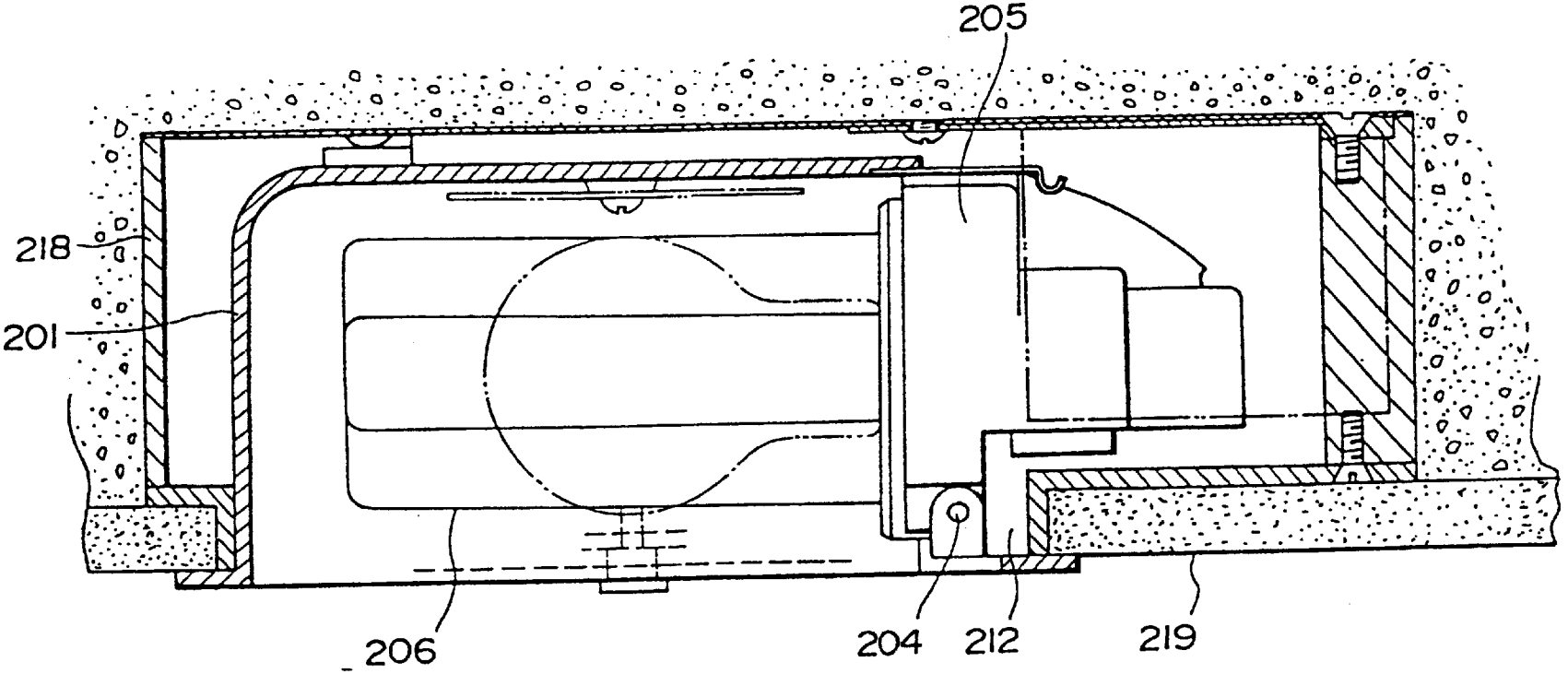
FIG. 18 is a partially cut out side view showing an essential part of another embodiment of the fixture according to the present invention by partly cutting a major part.

FIG. 18 is a partially cut out side view showing an essential part of another embodiment of the fixture according to the present invention. This configuration is typically for direct embedment in a slab or a wall surface (a blowing method), wherein a box-shaped embedded housing 218 is disposed at a desired location before concrete placing, and after completing the slab or concrete surface, a recessed body, a lamp socket, etc. are set through a mounting hole 212 opened in a decorative panel 219 in like manner as said embodiment.

Means using this housing 218 can be applied to the matting method by which a glass wool or rock wool heat insulator is spread in a ceiling, too.

Figure 19:
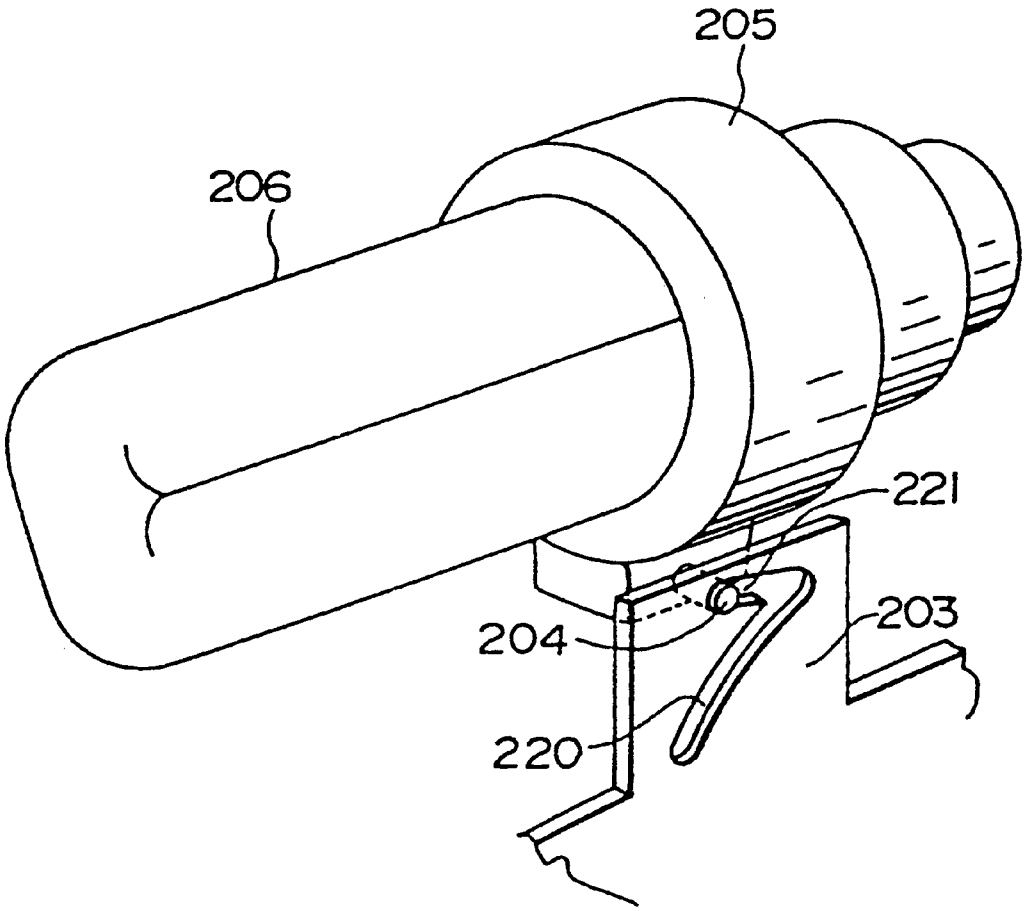
FIG. 19 is a perspective view showing an essential part of another embodiment of the fixture according to the present invention.

FIG. 19 is a perspective view showing an essential part of another embodiment of the fixture according to the present invention, wherein a long slit 220 is provided in each support piece 203 for supporting a shaft 204 solid with the lamp socket 205 and extending therefrom, the shaft 204 slidably fitted in the long slits 220, so that both the support shaft 204 and the lamp socket 205 are capable of swinging while moving along said slit 220. With the configuration as above, it is possible to reduce a space required for swinging the lamp socket 205 and the tube/bulb 206 or 206' in the body 201 than the space required by the embodiment illustrated in said FIGS. 17 and 18 by swinging the lamp socket 205 and the tube/bulb 206 or 206' (counter-clockwise in the figure) while moving said shaft 204 downward (toward the outside of the body 1) along the long slits 220 from a static condition where the support shaft 204 is positioned at bent hooked portions 221 of the long slits 220.

Therefore, according to the embodiment of FIG. 19, it is possible to make the body 201 more compact or use a longer discharge tube/bulb 206.

Figure 20:
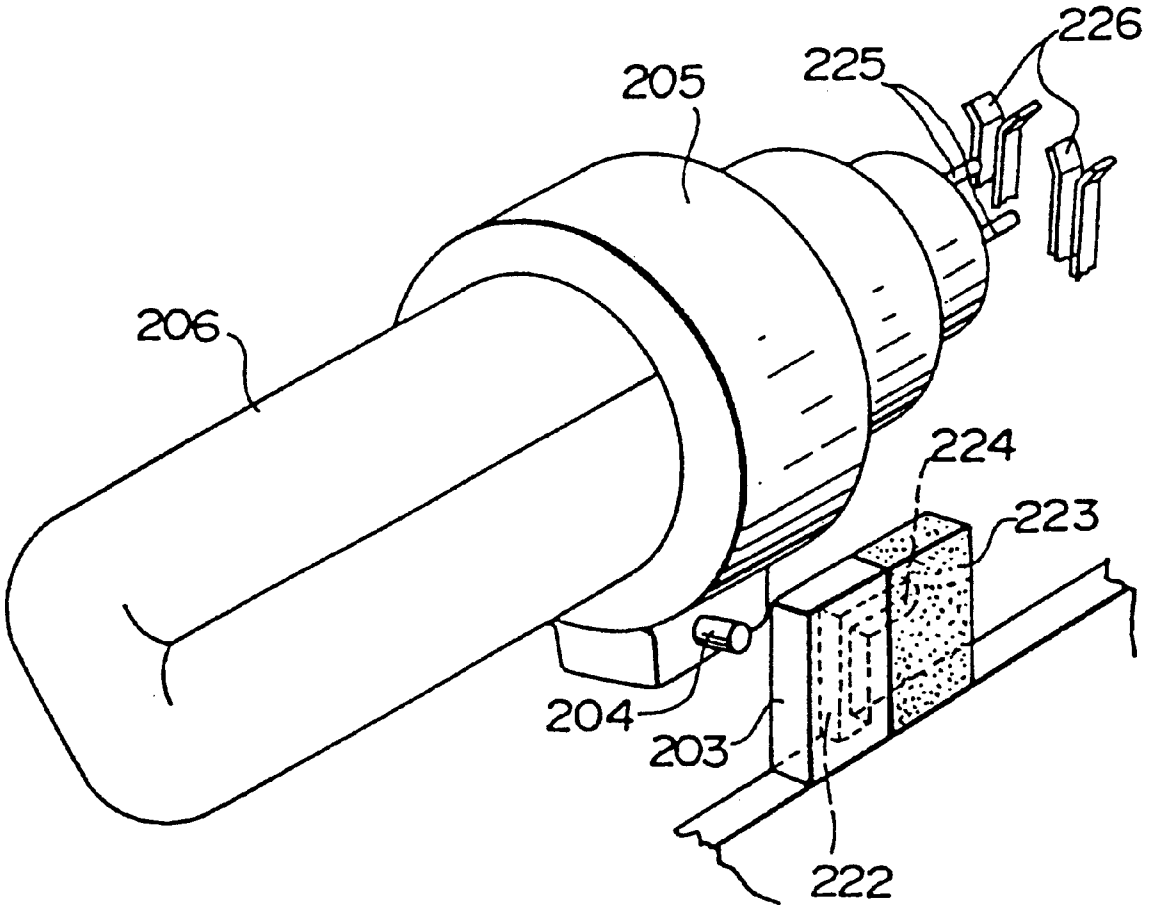
FIG. 20 is a perspective view showing an essential part of still another embodiment of the fixture according to the present invention.

Another embodiment shown in FIG. 20 has a similar configuration: said support shaft 204, made of iron, is inserted into a guide slit 222 of each support piece 203 from the lower open end thereof and is slid to the static position, and the part of each support piece 203 adjoining the guide slit 222, i. e. the part corresponding to said static position of the shaft 204, is provided as a recess 224 formed in a permanent magnet 223. Thus, it is possible to guide said shaft 204, in other words the lamp socket 205, into the recesses 224 of the hooked portions by inserting said shaft 204 together with the mounted tube/bulb 206 or 206' into the guide slit 222 from the lower end while moving and swinging said shaft 204 in the same manner as in said embodiment and hold the support shaft 204 having reached the recess 224 with magnetic adsorption. Further, the lamp socket 205 can be separated from the body 201 by lowering said shaft 204 together with the lamp socket 205, against the adsorption, along the guide slit 222 and removing them from the lower end. In this case, by providing an electric connection means to the lamp socket 205, namely by providing electrode pins 225 and 225 protruding rearward of said socket 205 and electrode pieces 226 and 226 that sandwich and thereby hold the electrode pins 225 and 225 at their static positions, it is possible to connect the power supply to the lamp socket 205 at the static position, remove said socket 205 from the body 201, and automatically open the power supply.

Figure 21:
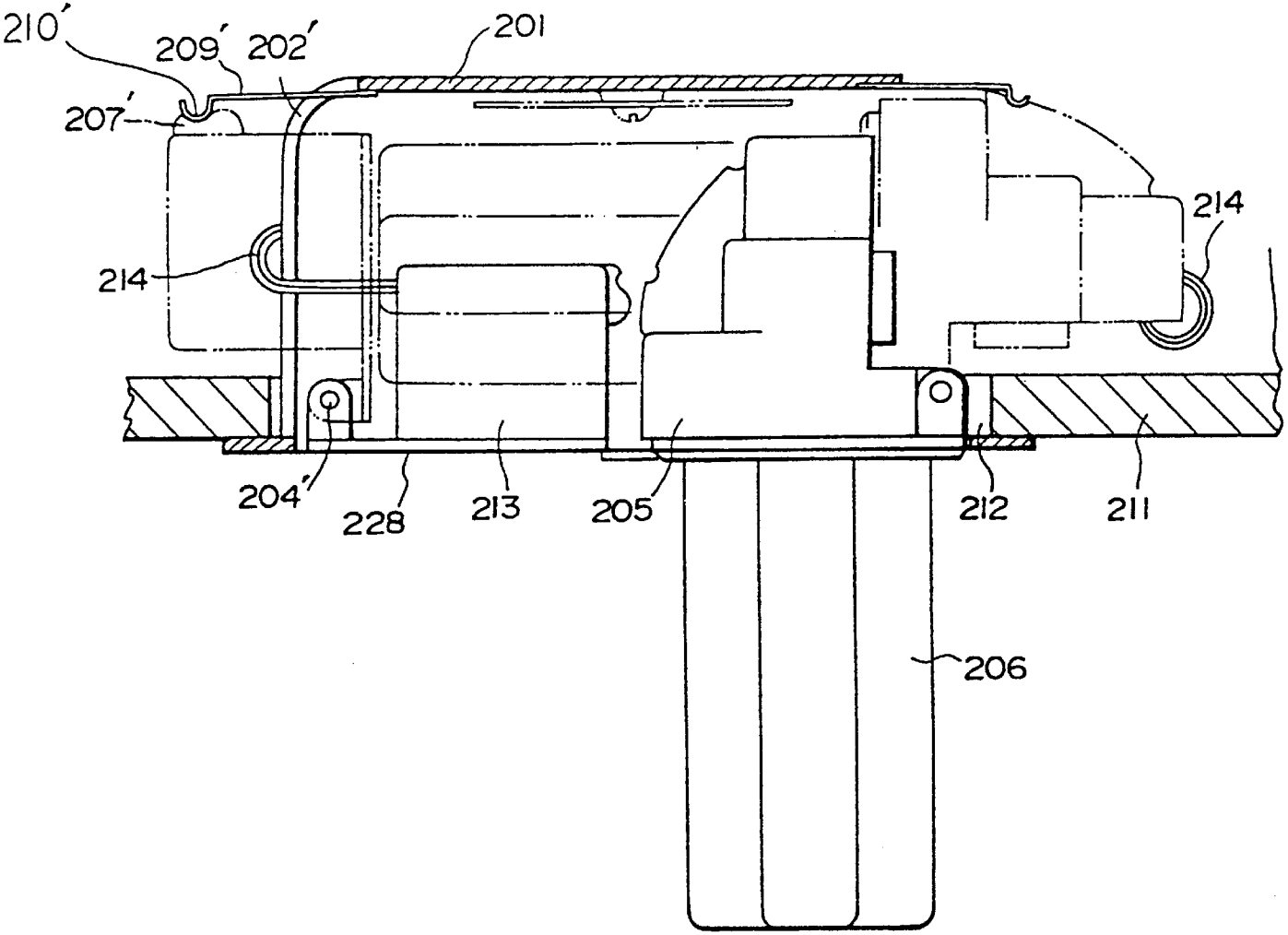
FIG. 21 is a partially cut out side view showing an essential part of still another embodiment of the fixture according to the present invention.

FIG. 21 is a partially cut out side view showing an essential part of still another embodiment of the device according to the present invention. In addition to the lamp socket 205 formed similarly to each of said embodiments, another open window 202' is provided on the other side wall of the body 201, and a lighting circuit member 213, such as a stabilizer, is fixed on a table 228 that can freely rotate around the other support shaft 204' that is provided at the lower edge of the open window 202', so that the table 228 is swung to a position illustrated with chain lines in the figure to make said lighting circuit member 213 moved to its static position where the member 213 protrudes outside the body 201 from the open window 202'. Other than the parts common to each of said embodiments, which are given the same reference numerals, a reference numeral 209' represents an elastic piece for holding the static position, and a reference numeral 207' represents a cam projection that engages with a holding projection 210' of said elastic piece 209'.

Also, in this embodiment, when the body 201 is mounted in the mounting hole 212 of the ceiling panel 211, the lamp socket 205 and lighting circuit members 213 are operated at a position to draw them into the body 201 illustrated with solid lines in FIG. 21, and after fixing the body 201, first the lighting circuit member 213 is swung together with the table 228 and brought outside the body 201, and then the lamp socket 205 is swung together with the mounted tube/bulb 206 or 206' and is brought to the body position shown with chain lines in the figure. At that time, if the lighting circuit member 213 and the table 228, shown with chain lines in the figure, are disturbing the swing of the mounted tube/bulb 206 or 206', they are rotated further outside the position to permit said tube/bulb 206 or 206' to move to the static position, and then the lighting circuit members 213 and the table 228 are returned to the illustrated position, or, the means proposed by said embodiment illustrating the circuit may be applied to either or both of 204 and 204'.

Figure 22:
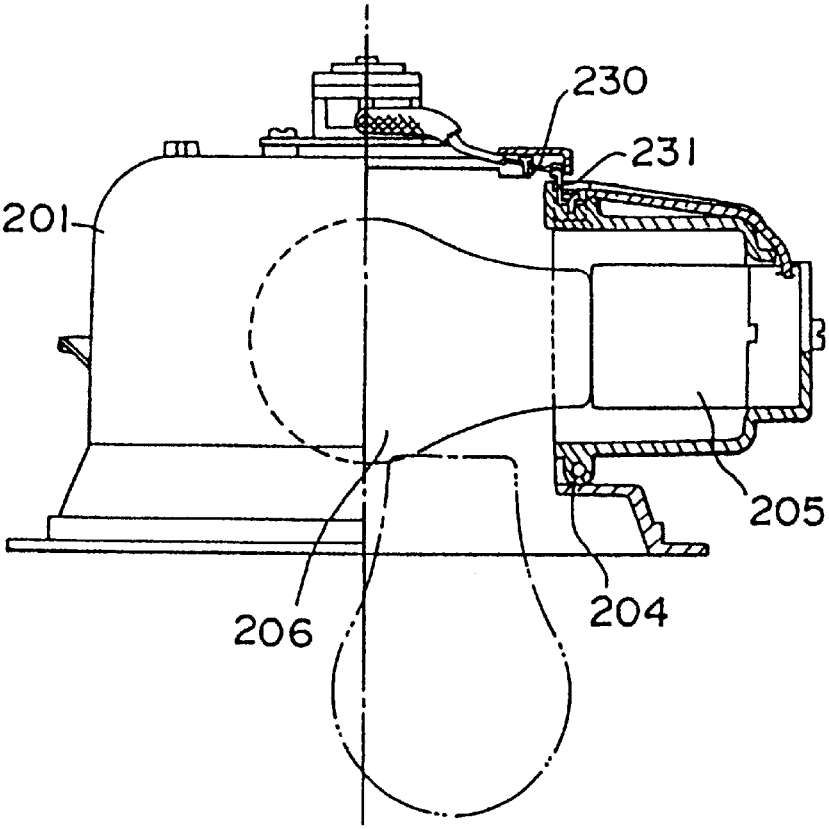
FIG. 22 is a partially cut out side view showing another embodiment of the fixture according to the present invention.
Figure 23:
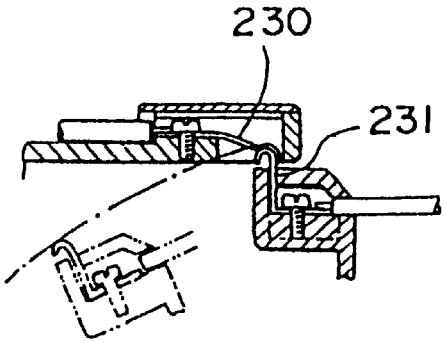
FIG. 23 is an enlarged sectional side elevation showing an essential part of the fixture according to the present invention.

FIG. 22 shows another embodiment of a safety switch of the fixture according to the present invention. It is a sectional side elevation, and FIG. 23 is an enlarged side view of an essential part, wherein a member corresponding to said elastic piece 209 of the embedded body 201 is formed as a fixed electrode piece 230 and a movable electrode piece 231 extended from the swingable lamp socket 205 faces said fixed electrode piece 230, and the ends of both electrode pieces 230 and 231 where they come into contact during a swinging motion are formed into a recess and a protrusion respectively for mutual engagement. Accordingly, when the lamp socket 205 swings and reaches the prescribed use position with regard to the body 201, the recessed and protruded parts of the respective electrodes 230 and 231 mutually engage to electrically connect them together and mechanically hold the lamp socket 205 at the prescribed position at the same time. Also, in cases where electrical connection is effected by both electrodes of a power supply circuit, the single-pole arrangement of the aforementioned movable electrode piece 231 and fixed electrode piece 230 may be formed as a two-pole arrangement in a parallel arrangement.

Figure 24:
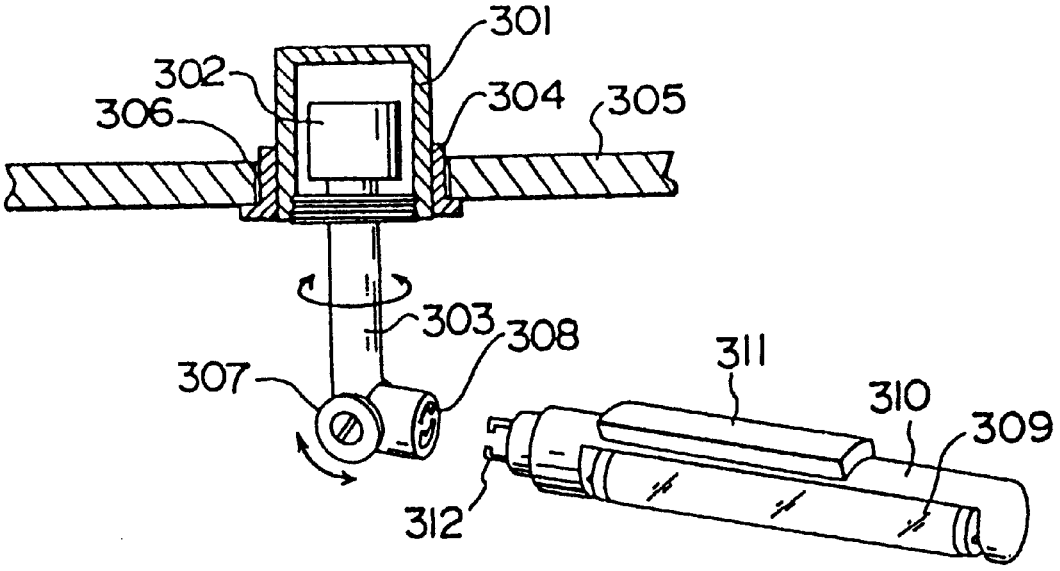
FIG. 24 is a perspective view showing a second embodiment of a luminaire according to the present invention.

FIG. 24 is a partially cut out perspective view showing an embodiment of a luminaire according to the present invention, wherein a reference numeral 301 is a fixture body inserted into a housing 304 that is previously fitted in a mounting hole 306 opened in a ceiling (installation surface) 305, and by means presented as above they are mechanically caught and electrically connected at the same time. In the fixture body 301, a rotatable joint 302 is provided and a center shaft tube 303 is extended downward from it. The end of said center shaft tube 303 can freely rotate by making a right angle with the ceiling (installation surface) 305 via a hinge joint 307.

Further, a socket metal 308 of a twist-lock ceiling box is provided as a power supply portion at the end of the center shaft tube 303. A reference numeral 309 is a fluorescent lamp, which has a reflection panel 310 that also functions as a support panel, and is provided with a stabilizer 311 mounted thereon and claw electrodes 312 of the twist-lock ceiling box, the claw electrodes serving as a power receiving portion. Accordingly, when in use, the claw electrodes 312 are inserted into the metal socket 308 at the end of the center shaft tube 303 and is rotated to effect electrical connection and mechanical engagement (FIG. 24). Since the center shaft tube 303 is rotatable, the mounted fluorescent lamp 309 is capable of rotating horizontally in parallel with the ceiling 305, and yet it can be rotated vertically by the joint 307.

Figure 25:
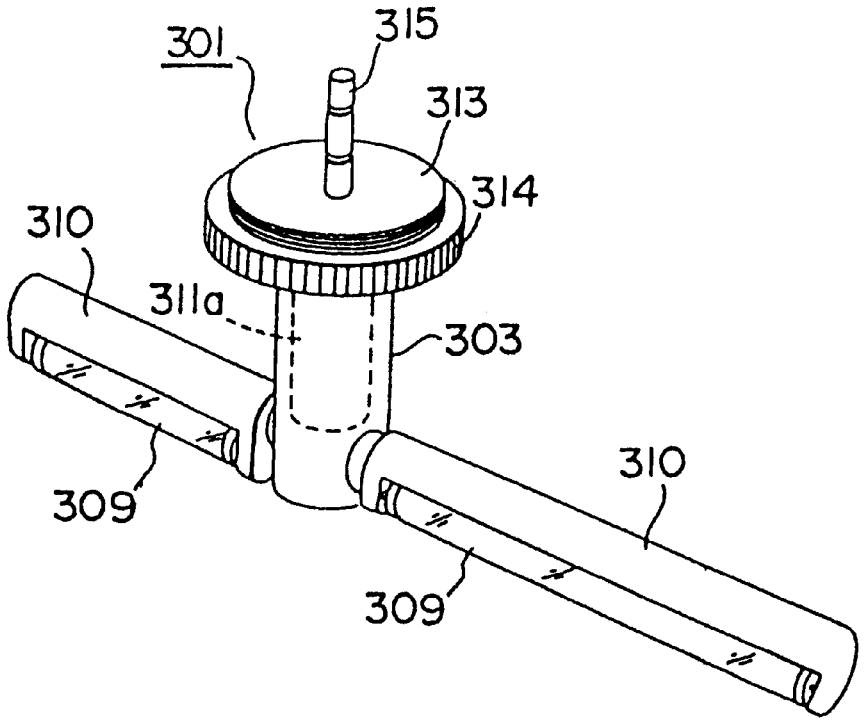
FIG. 25 is a perspective view showing a third embodiment of the luminaire according to the present invention.

FIG. 25 is a perspective view showing another embodiment of the fixture according to the present invention, wherein the fluorescent lamp 309 having a coaxial plug electrode 315 as a power receiving portion is fitted to the fixture body 301 having a coaxial receptacle electrode by screwing a fastening ring 314. These fastening ring 314 and flange 313 are joined in such a manner as to freely rotate while being prevented from slipping off, and the fluorescent lamp 309 electrically connected by way of the coaxial plug electrode 315 can rotate around the shaft tube 303 together with this shaft tube 303. A reference numeral 311*a* denotes a stabilizer built in the center shaft tube 303.

Figure 26:
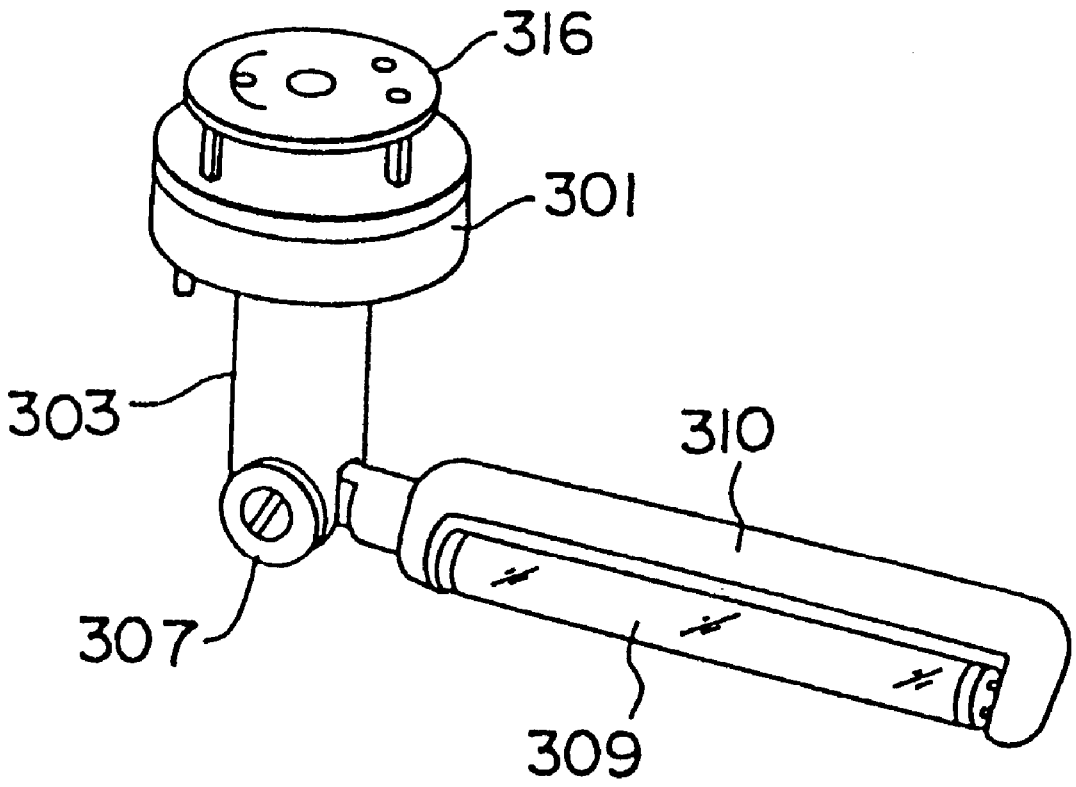
FIG. 26 is a perspective view showing a fourth embodiment of the luminaire according to the present invention.

FIG. 26 is a perspective view showing another embodiment of the fixture according to the present invention when in use, wherein the fixture body 301 may also be used in the state where it is directly attached to a flange base 316.

Figure 27:
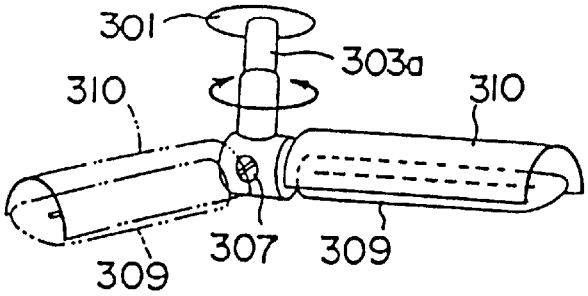
FIG. 27 is a perspective view showing a fifth embodiment of the luminaire according to the present invention.
Figure 28:
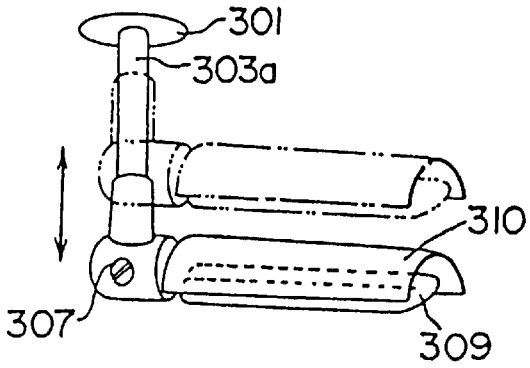
FIG. 28 is a perspective view showing a sixth embodiment of the luminaire according to the present invention.
Figure 29:
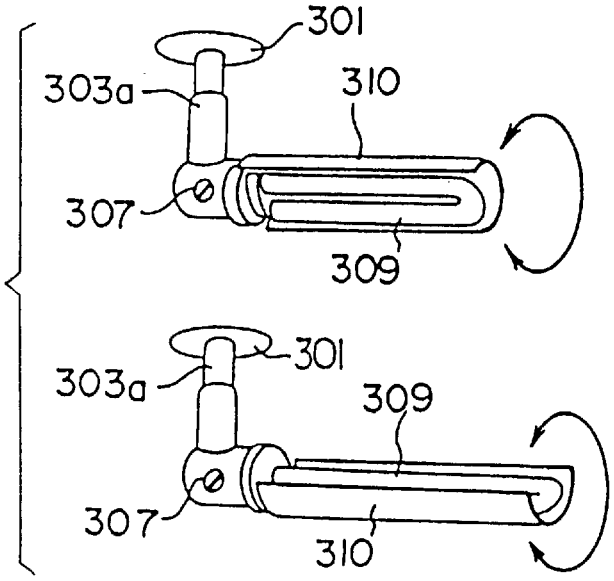
FIG. 29 is a perspective view showing a seventh embodiment of the luminaire according to the present invention.

FIG. 27 through FIG. 30 are perspective views showing each of other embodiments of the fixture according to the present invention. In addition to a linearly opposite arrangement, the fluorescent lamp 309 shown in said FIG. 26 may also be arranged in such a manner as shown in FIG. 27, wherein a plurality of lamps are arranged around the center shaft 303*a*, or may be moved vertically by operating the center shaft 303*a* formed as a double-tube shaft (FIG. 28), or the reflection panel 310 of the fluorescent lamp 309 can be rotated around the fluorescent lamp 309 so as to adjust light volume and make a selection between direct lighting and indirect lighting by changing the operating position of the reflection panel 310 as shown in FIG. 29.

Figure 30:
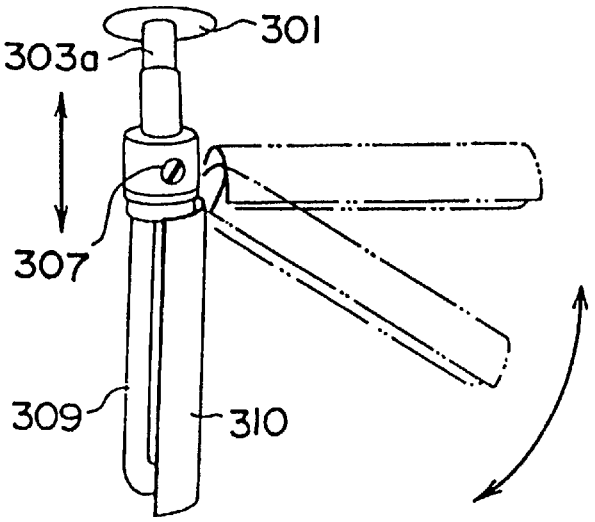
FIG. 30 is a perspective view showing a progressive embodiment of the luminaire according to the present invention.

Further, as shown in FIG. 30, by combining the extensible center shaft 303*a* and the vertical swing of the fluorescent lamp 309 effected by the hinge joint 307, a local lighting or an evasive lighting to prevent reflection can be effectively attained. Accordingly, by combining varying mechanisms including the various rotations described above, a luminaire that affords multiple variations can be obtained.

Figure 31:
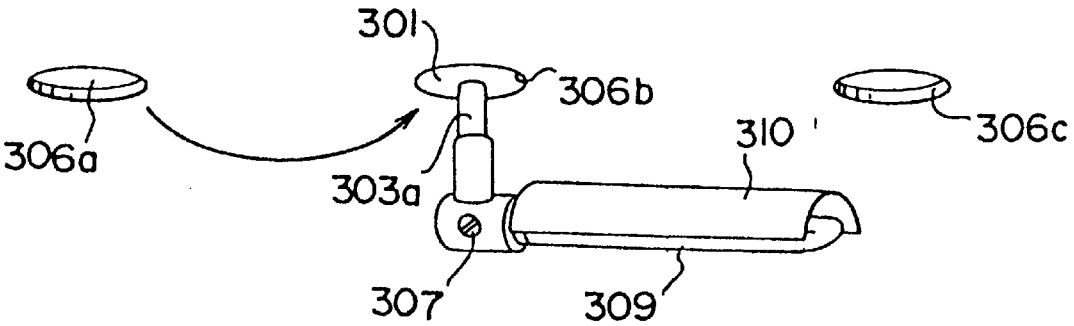
FIG. 31 is a perspective view showing the luminaire according to the present invention when it is set.
Figure 32:
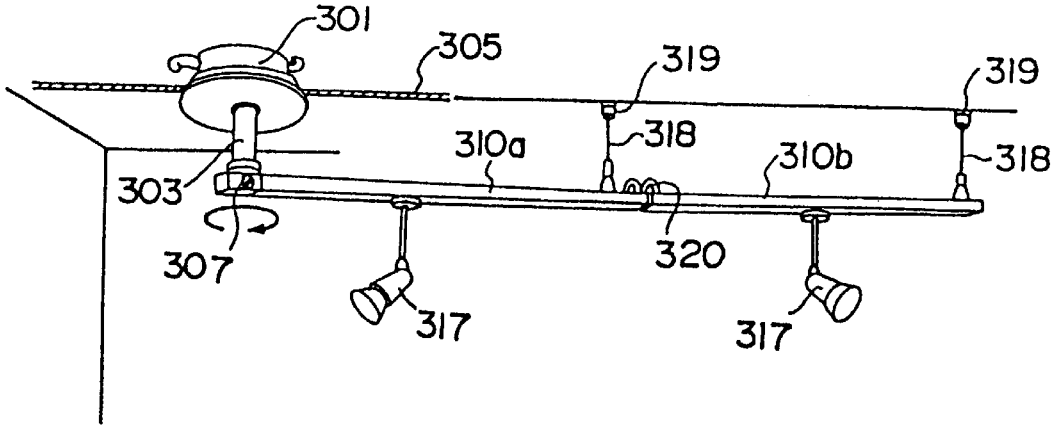
FIG. 32 is a perspective view showing an eighth embodiment of the luminaire according to the present invention.

Moreover, as shown in FIG. 31, in combination with such a manner of usage as relocating the fixture body 301, directly or by means of said housing 304, into mounting holes 306*a*, 306*b*, 306*c*, etc. prepared beforehand, the fixture may attain further improved versatility.

Figure 33:
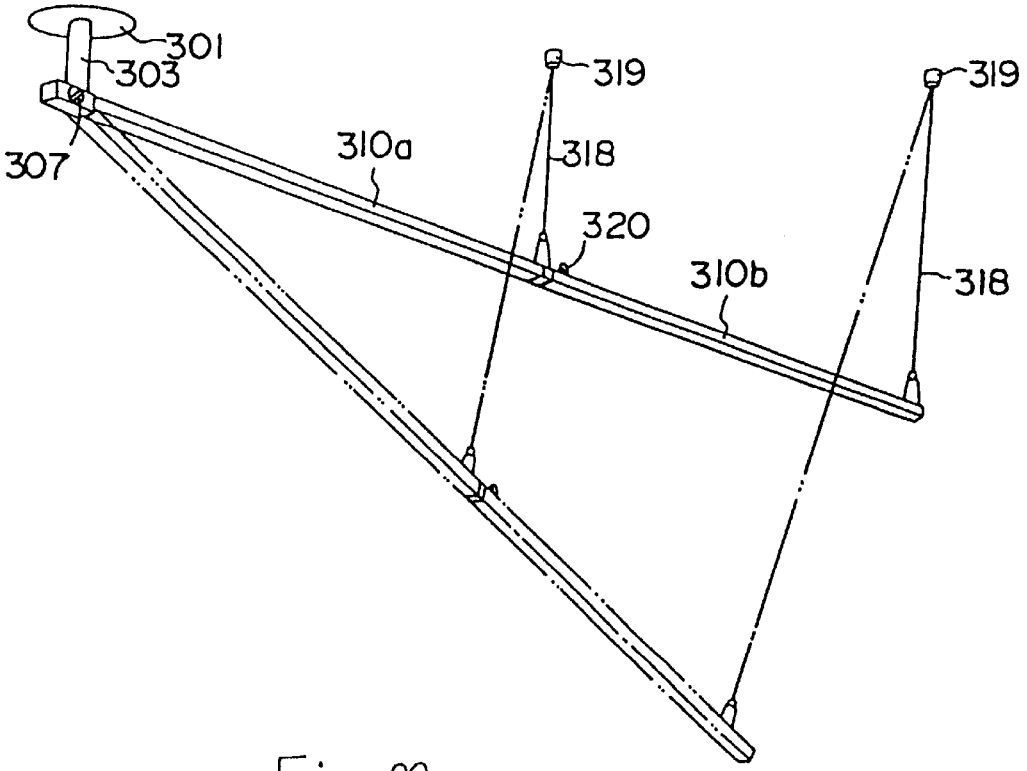
FIG. 33 is a perspective view showing the eighth embodiment of the luminaire according to the present invention when in use in another manner.

FIG. 32 through FIG. 36 are perspective views respectively showing various manners of usage of a fixture using a lighting duct according to the present invention, wherein, when lighting ducts 310*a* and 310*b* are used as supports for light source bulbs in the present invention, these ducts 310*a* and 310*b* are joined by a hinge 320. When arranged along the surface of the ceiling 305, the ducts 310*a* and 310*b* are hung from the ceiling 305 by using fixed hooks 319 and hanger strings 318 provided at appropriate locations. In addition, by adjusting the lengths of the hanger strings 318, the lighting ducts 310*a* and 310*b* can be arranged in an inclined condition as shown in FIG. 33. In this case, the hinge joint 307 at the end of the center shaft tube 303 functions effectively.

Figure 34:
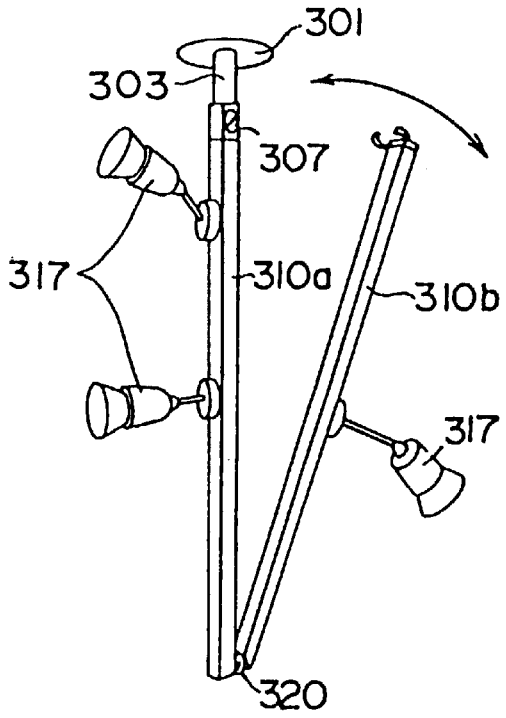
FIG. 34 is a perspective view showing a ninth embodiment of the luminaire according to the present invention.
Figure 35:
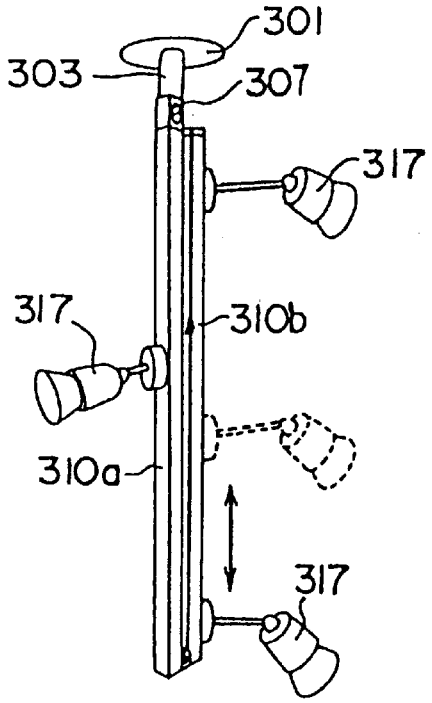
FIG. 35 is a perspective view showing the ninth embodiment of the luminaire according to the present invention when in use in another manner.
Figure 36:
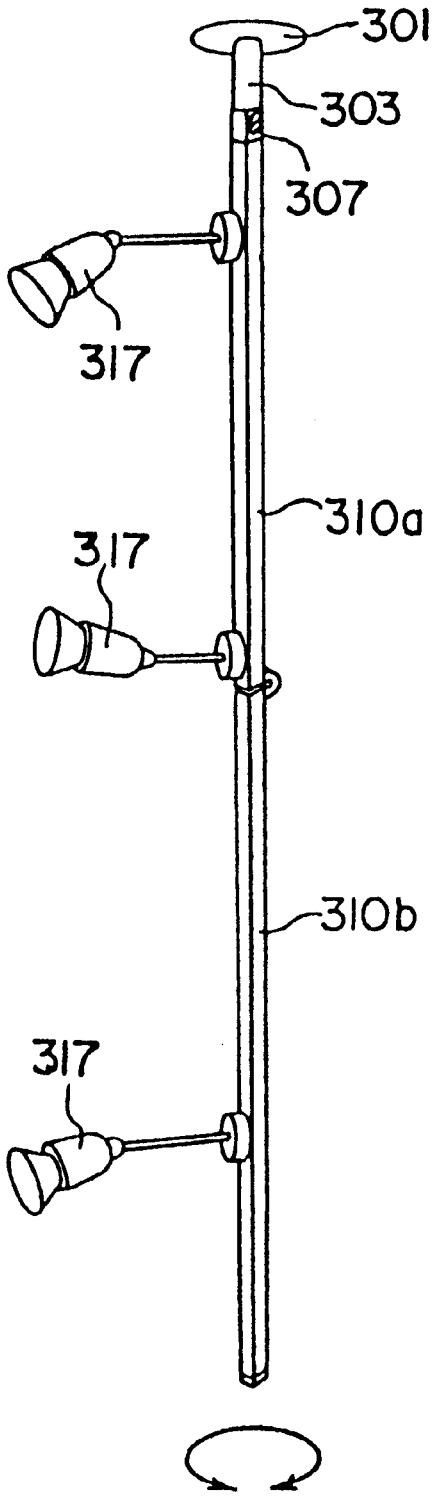
FIG. 36 is a perspective view showing the ninth embodiment of the luminaire according to the present invention when in use in still another manner.

Also, by bending lighting ducts 310*a* and 310*b* at the hinge 320 as shown in FIG. 34 or FIG. 35, various style variations are available, which is effective for shop lighting and convenient for display changes. Further, as shown in FIG. 36, it is also possible to use lighting ducts 310*a* and 310*b* in a vertical condition, and in this case, using the rotatability of the center shaft 303, it is possible to change the orientations of incandescent lamps 317 and 317 together with these ducts 310*a* and 310*b*.

Figure 37:
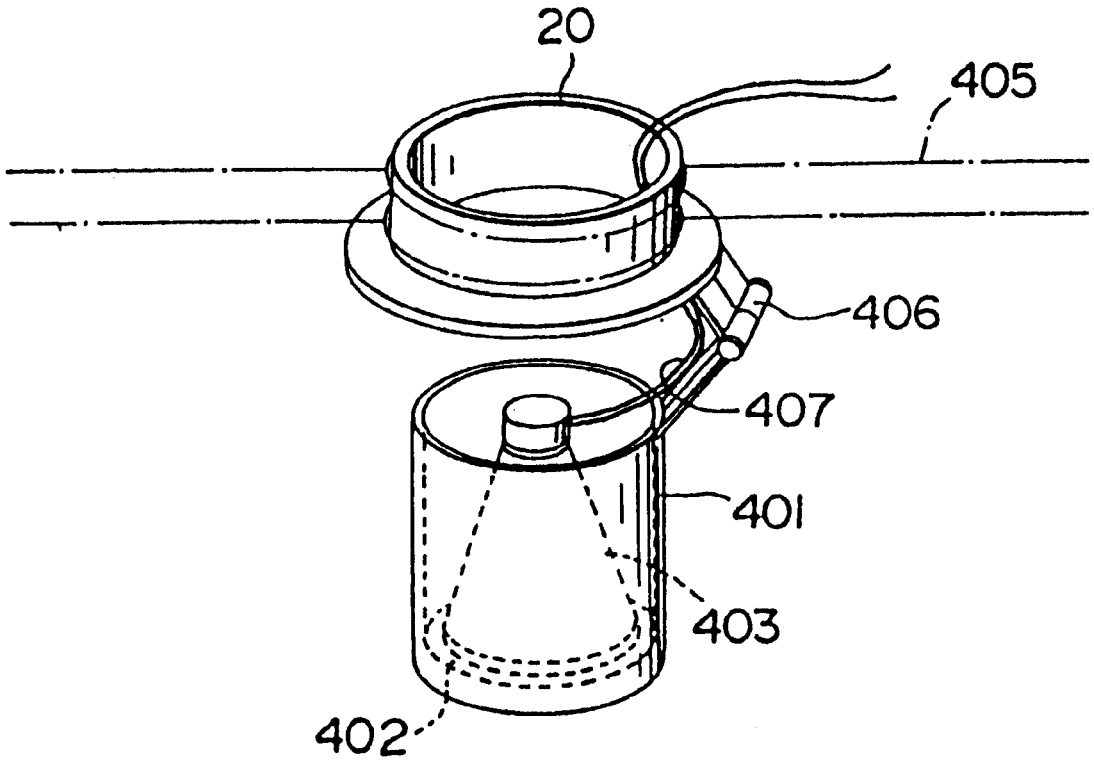
FIG. 37 is a perspective view showing a structure of a device according to the present invention.
Figure 38:
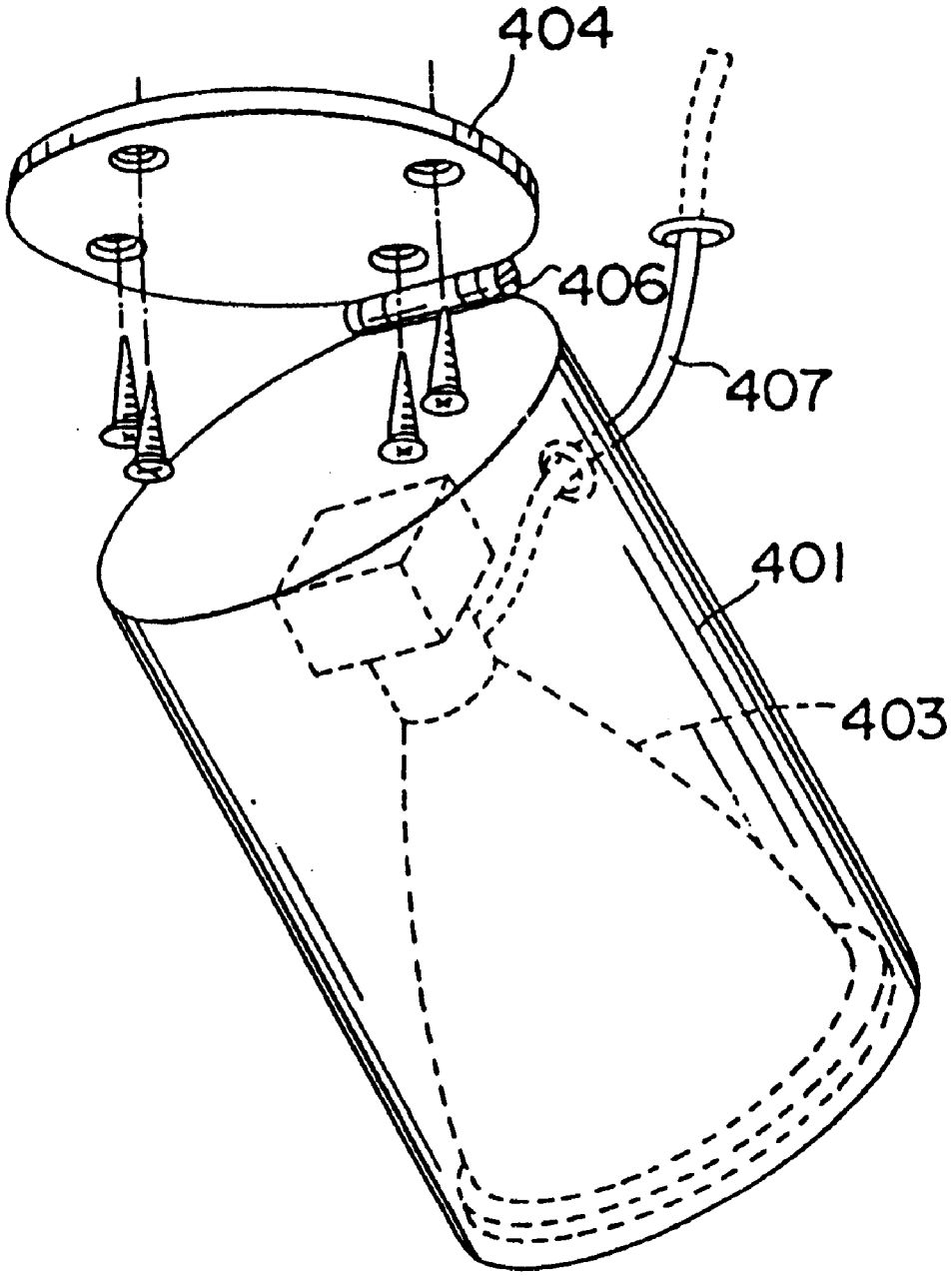
FIG. 38 is a perspective view showing a structure of an embodiment of the device according to the present invention.
Figure 39:
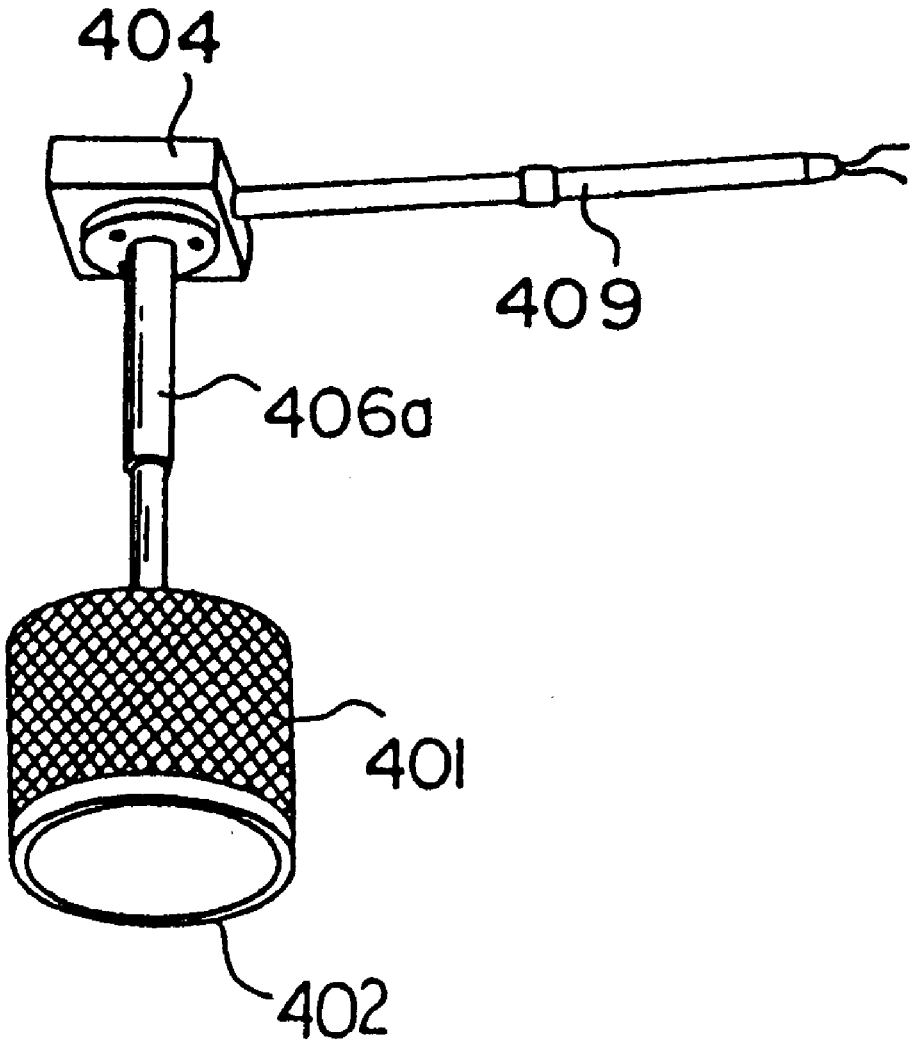
FIG. 39 is a perspective view showing another embodiment of the device according to the present invention.

FIG. 37 is a schematic illustration explaining a structural principle of an attachment device according to the present invention; FIG. 38 is a perspective view showing an embodiment of the device according to the present invention; and FIG. 39 is a schematic illustration showing another embodiment of the device according to the present invention. In these figures, a reference numeral 401 is a tubular body made of a metal, a heat resistant synthetic resin or the like having a cylindrical shape identical to that of the housing 20 shown in said FIG. 6, around the lower inner periphery of which a brim 402 having the same inside diameter as that of a mounting hole in a ceiling panel 405 is provided. A reference numeral 403 is an embedding fixture such as a lamp housing, which is inserted from the underside of said tubular body 401 and is fitted in said brim 402. It is as if a new housing 20 or a mounting hole exposed to the air were provided by forming the tubular body 401 in the shape of said housing 20 or so as to have the inside diameter same as the mounting hole.

The upper end of the tubular body 401 is, for example, fixed by way of a hinge 406 to a fixed member such as a housing 20, which is attached to a mounting hole or the like in a conventional ceiling panel 405 by well-known various means. In addition, when the tubular body 401 is affixed to, for example, a beam member of an exposed ceiling, other well-known fixing members, such as a clamp or, as shown in FIG. 38, a screwed fixing member 404, may be employed. Furthermore, other than the type to be mounted by fitting the edge of the fixture directly in a mounting hole in the ceiling, the embedded fixture 403 may also be of a type to be fitted in a housing 20. Additionally, a reference numeral 407 is a connection cord to be connected to an indoor wiring by using a connection fixture such as a plug. A reference numeral 409 is a cord pipe for passing through said connection cord 407.

Further, a fitting direction of the fixing member 404 of said tubular body 401 can be changed freely by providing another hinge at the upper fitting edge of said tubular body 401, in addition to disposing said hinge 406 between the fixing member 404 and the tubular body 401. Also, instead of another hinge, a hanging double-tube pipe 406*a* (FIG. 36 may be used so that the distance between the fixing member 404 and the tubular body 401 and consequently the fitting height of the tubular body 401, in other words the embedded fixture mounted therein can be adjusted by extending or contracting the pipe 406*a*.

Additionally though not shown in the figure, as yet another embodiment of the attachment device according to the present invention, by arranging said brim 402 to have a variable inside diameter by using a continuously variable means, such as a diaphragm structure, or by using step-variable means such as changing the brim 402 itself, it can be applicable to embedded fixtures with different outside diameters.

Figure 40:
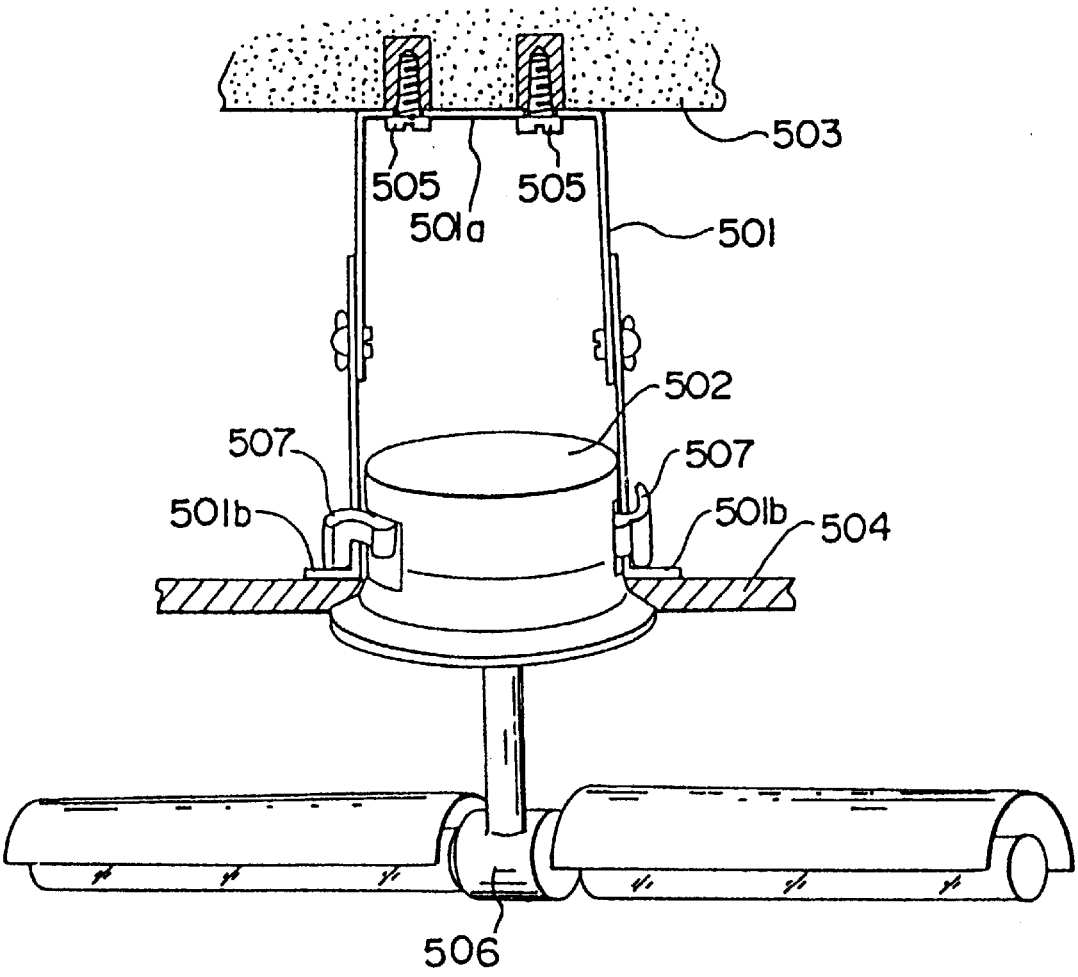
FIG. 40 is a side view showing the device according to the present invention when in use.
Figure 41:
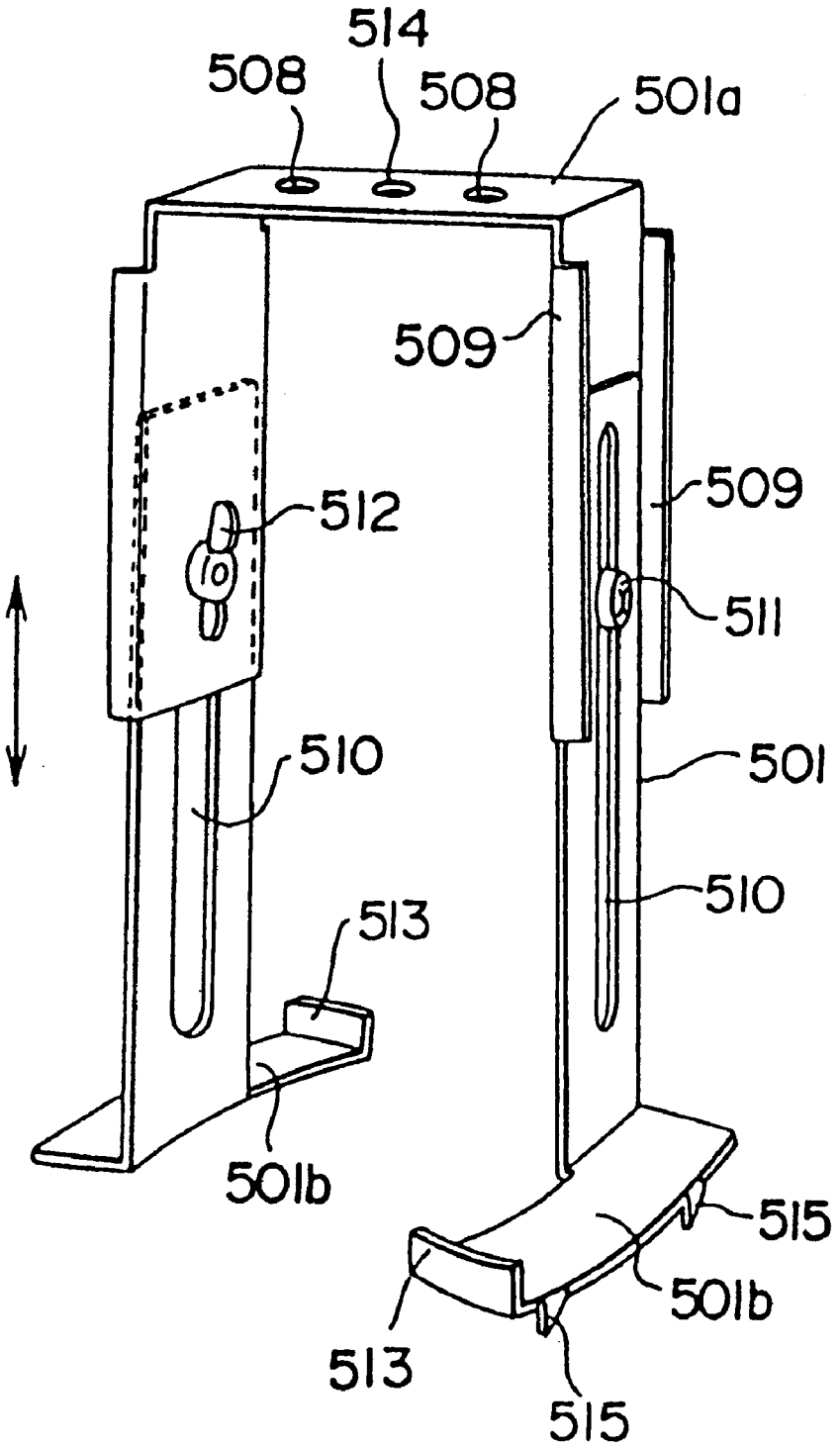
FIG. 41 is a perspective view showing an embodiment of the device according to the present invention.

FIG. 40 is a side view showing a manner of usage of an attachment device for a fixture according to the present invention, and FIG. 41 is a perspective view showing an embodiment of a device according to the present invention. In these figures, a reference numeral 501 is a saddle-shaped column of which a flat top 501*a* is disposed on a slab 503 and fixed thereto with screws 505 and 505. Fixing with these screws 505 and 505 is to prevent the column 501 from rotating on the plane of the slab 503 during use. In cases where other securing means, such as applying a bonding agent to the surface where the top 501*a* and the slab 503 are in contact with each other, and then applying pressure to bond the two members together, is employed, one screw alone may be sufficient.

As shown in FIG. 40, the lower end of the column 501 is formed as extended edges 501*b* extending along a ceiling panel 504, which are held together with the ceiling panel 504 between projected pieces 507 of an embedded container 502 and a front stop brim of said embedded container 502. The embedded container 502 is a tubular body made of a metal or a synthetic resin, into which fixture mechanisms other than a lamp casing 506, such as a transformer and other lighting circuit members, a rotation mechanism and so on are incorporated, and said stopping mechanisms (FIG. 1) or mechanical stopping means comprised of stopping levers 31 (FIG. 8) are provided on the outer surface of the peripheral wall of the tubular body.

As shown in FIG. 41, the column 501 has a space to fit the embedded portion of the embedded container 502 therein. The vertically extending column 501 is separated into the upper and lower portions with the ends of both parts spliced together. Bent-and-lifted guide rails 509 are provided at edges of the spliced portions of the upper portion of the column 501, and a guide slit 510 is formed in each side of the lower portion of the column 501 so that by fastening, by means of a butterfly nut 512, a screw 511 that is slidably fitted in each slit 510 and is passed through a screw hole formed in the upper portion, both parts are fixed to each other and that the length of the column 501 can be adjusted by loosening said butterfly nuts 512 to adjust the length of the spliced portion. Further, a reference numeral 513 is a stopper formed at the end of each extended edge 501*b* to prevent the projected piece 507 from slipping off the edge 501*b*, fixing claws 515 that bite the ceiling panel 504 in contact therewith are provided on the back of each extended edge 501*b*, and a reference numeral 514 is a cord hole provided at the top 501*a* of the column 501.

When mounting an attachment device structured as above according to the invention on an installation surface, a mounting hole is formed in the ceiling panel beforehand, and the attachment device is inserted through this mounting hole towards the slab 503. At that time the pair of extended edges 501*b* at the bottom of the column 501 are inserted into the mounting hole in the ceiling panel 504 while being pinched from both sides. In the state the column 501 is completely inserted, butterfly nuts 512 of the height adjusting mechanism are loosened so as to adjust the height of the column such that the top 501*a* is in contact with the slab 503 while the extended edges 501*b* are in contact with the ceiling panel 504. Thereafter, the nuts 512 are tightened to secure the column 501. Of course, in cases where a column 501 having a height adjusting mechanism is not available, a column 501 having the same height as the distance between the slab and the ceiling panel, said distance having been measured beforehand, should be selected.

Next, while holding the column 501 by hand at the position corresponding to the mounting hole, hole positions are marked on the slab 503 through screw holes 508 and 508 of the top 501*a*. Then, the column 501 is moved to a side, and screw holes are drilled at the respective marked positions. Thereafter, the column 501 is returned to the mounting hole position, screws 505 and 505 are inserted into the screw holes in the slab 503 through screw holes 508 of the top 501*a*, and thereby said column 501 is fixed to the slab 503.

As shown in FIG. 40, the embedded container 502 is then set through the mounting hole into the inner space of the column 501 installed as above. The embedded container 502 is provided with a structure having projected pieces 507 and 507 serving as a fixing means (as in, for example, the stopping mechanisms 7 shown in FIG. 6). As the projected pieces 507 and 507 are projected outward from the fixture and moved downward by operation from the outside of the fixture, the pieces 507 and 507, located on the respective extended edges 501*b*, move downward, while being prevented by the stoppers 513 from slipping off from the extended edges 501*b*, so that each extended edge 501*b* becomes firmly supported, together with the ceiling panel 504, between the outer brim of the embedded container 502 and the corresponding extended piece 507.

Of course, the embedded container 502 and the column 501 can be removed by performing the above-mentioned installing operation in the reversed order. Also, as an auxiliary means for the above-mentioned height-adjusting mechanism for the column 501, or as a means for fine height-adjustment of the column 501 that has no height adjustment mechanism, it is possible to use a desired number of block members having a specified thickness between the top 501*a* of the column 501 and the slab 503, and the column 501 may also be formed in a cylindrical shape.

Figure 42:
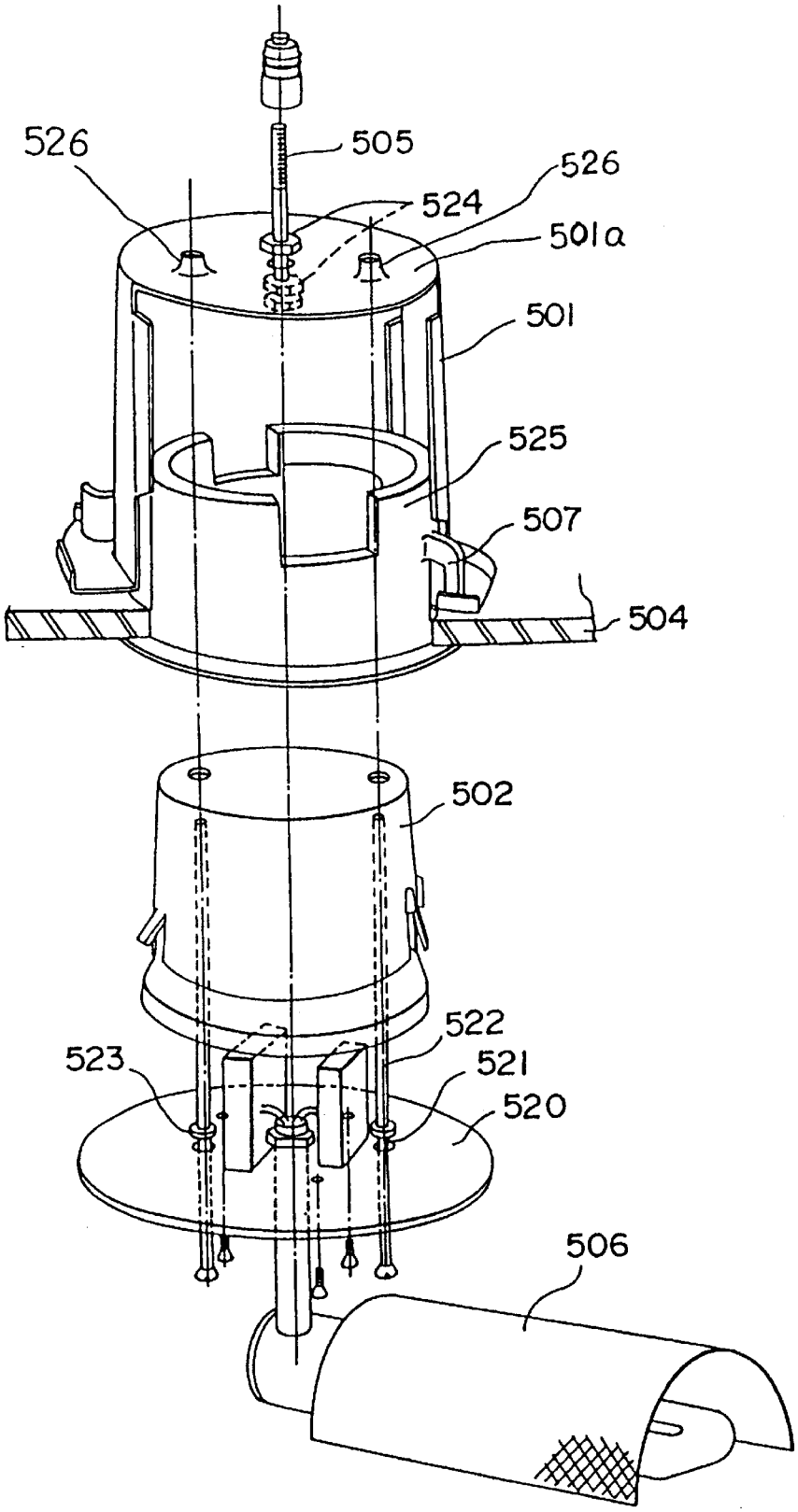
FIG. 42 is an exploded side view showing another embodiment of the device according to the present invention when in use.
Figure 43:
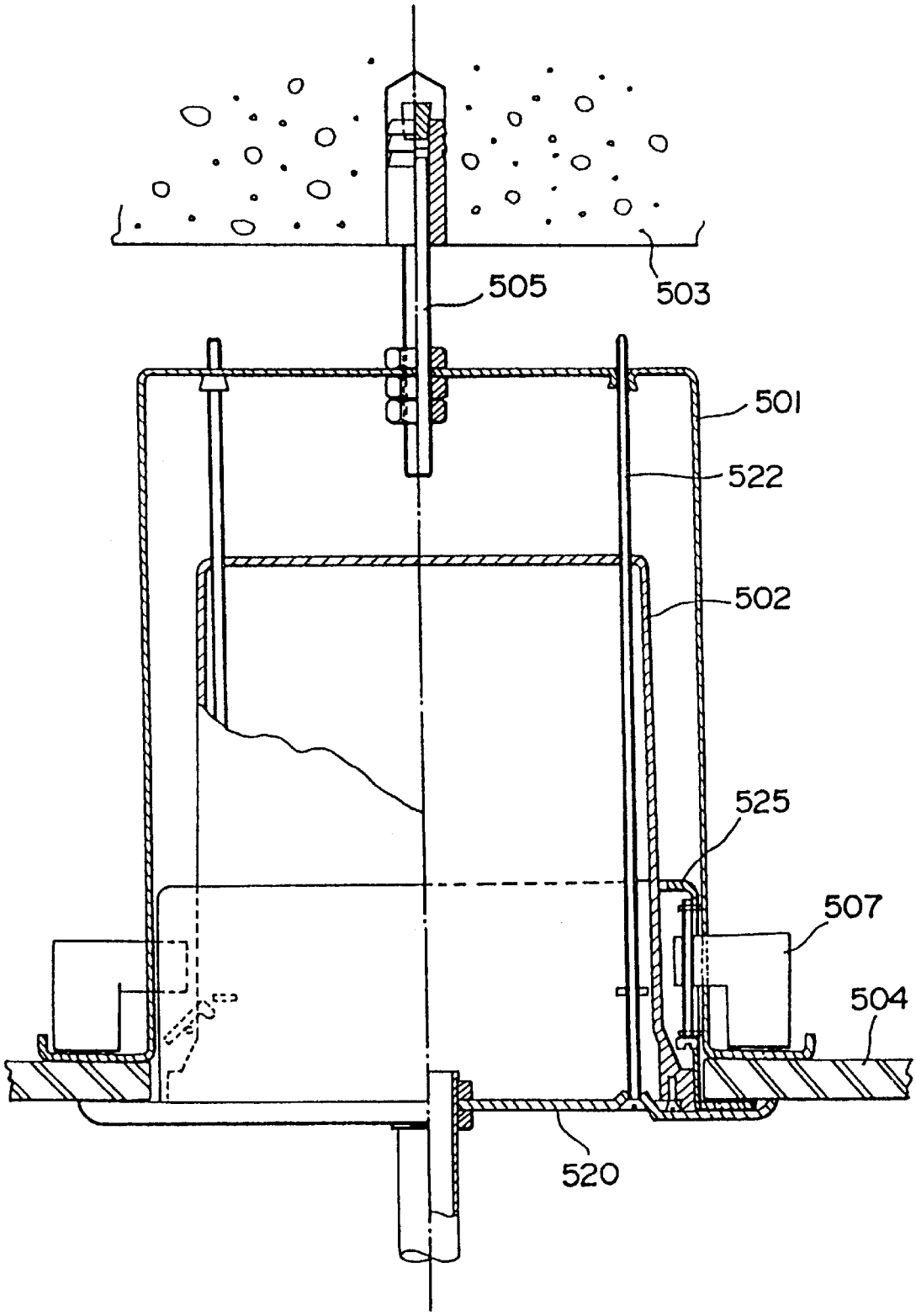
FIG. 43 is a partially cut out side view showing the device according to the present invention when in use.

FIG. 42 and FIG. 43 are respectively an exploded perspective view showing another embodiment of the attachment device for the fixture according to the present invention and a partially cut out side view showing a manner of usage of said attachment device. In these figures, the same functional members as those of the embodiment of the aforementioned FIG. 40 and FIG. 41 are given the same reference numerals, and there is provided with a bottom cover plate 520 for covering the lower surface of the embedded container 502 and the mounting hole in the ceiling panel 504, said embedded container 502 set in the mounting hole either directly (a single type) or via a housing 525 (a unit type). In the top 501*a* of the column 501, two nut holes 526 are provided at a distance.

Two bolts 522 are thrust from small holes 521 of the bottom cover plate 520 through the embedded container 502 and are tightly fastened in nut holes 526 of the aforementioned top 501*a*.

As a result, by holding the ceiling panel 504 between the lower extended edge 501*b* of the column 501 and said bottom plate 520, the embedded container 502 is held as shown in FIG. 43 so that the column 501 fixed to the slab 503 via the bottom plate 520 supports the weight of the embedded container 502. Also, a reference numeral 523 is a stop ring attached to the lower portion of each bolt 522 to prevent it from falling before assembling. A reference numeral 524 is a nut to fix the screw 505.

As described above, according to the present invention, by forming a lamp casing to have a bullet-shaped outline, mounting/dismounting in and from a mounting hole bored in a ceiling or the like is easily possible, and as a stopping mechanism is provided on the sloped outer surface, a wide reflection surface can be secured inside the bullet shape to improve a light efficiency of the luminaire, and, since the reflection surface can easily be formed in a desired shape, a required light distribution can be attained.

Also, in each stopping mechanism, the projected piece is set along the outer wall of the fixture during an operation for mounting or dismounting the fixture in or from the mounting hole, it will not be in the way when the fixture is installed in or removed from a mounting hole having a small diameter, and by rotating the threaded shaft, the projected piece is protruded outside the fixture and moved toward the shaft to hold the mounting hole edge between the projected piece and the flange of the fixture and fasten the fixture tightly and stably, while ensuring the fixture to easily be removed. Further, since fixture handling can be done easily without the need for inserting finger tips into the fixture, it is possible to perform the operation with a light source tube/bulb installed in the fixture.

By forming the fixture casing as an assembly of a relatively simple, bullet-shaped lamp casing and a base including a flange, it is possible to form the base, which has a more complicated structure than the lamp casing, by using suitable materials and processing means for the respective parts to allow them to function in the optimum condition, and thus it is possible to provide many fixture shapes by combining parts with different shapes that are produced by using a minimal number of molding dies.

As a fixture according to the present invention stated in claim 8 provides an embedded housing fitted in a mounting hole beforehand, a use of a temporary work lamp during a new construction or a replacement of light source tube/bulbs for a performance adjustment immediately before completing the construction is easy, fixtures can be replaced when a room design is changed after the construction, and as needed, various fixtures and apparatuses, such as smoke sensors and heat sensors, can easily be installed. Thus, a fixture according to the present invention, of which the embedded housing in the installation surface can permanently be used, is distinguished in an ease of construction operation and economy.

By mechanically engaging and electrically connecting the above-mentioned housing and the fixture installed therein, installation of the fixture can be made more convenient. Should there be any fear of an accident resulting from a possible error in an operation, it can be solved by providing a sensor so that the operation can be done safely and reliably.

Since the sensor is comprised of a normally closed switch that operates by a lever which also functions as a mechanical stopping member, the electrical connection of the fixture can be completed and recognized either simultaneously with or immediately after the housing of the fixture.

According to the aforementioned structure of each stopping mechanism as claimed in any claim from claim 16 to claim 19, since the projected piece and the like are assembled in the support frame and the entire support frame is mounted on a designated point of the mounting hole, the stopping mechanism can be attached directly to the fixture as well as to the housing, and thus various fixtures can be securely installed in mounting holes. Furthermore, since the structure of the device itself is simple, with none of the component members requiring any special processing, it is possible to provide the device at a relatively low price, and, with a strong holding force of the projected piece to the mounting hole edge, the recessed-type fixture can be fixed more stably and it can be removed safely and easily without causing any unreasonable force to the projected pieces during removal. Further, application is possible to a wide range of installation surface from thick to thin ceiling panels.

Also, since the static position of each projected piece in the frame can be secured by the stopper's action and a frictional resistance is given to the threaded shaft against rotation, it is possible to prevent an accidental movement of the projected piece from the static position in the frame, and in particular as each projected piece forms a curved surface along the outer wall of the lamp casing, it is sufficiently compact as not to obstruct installation or removal from the mounting hole. Thus, this structure makes said lamp casing even more convenient to be installed and removed.

According to the fixture of the present invention stated in claims 20 and 21, wherein the downlight and lamp socket horizontally set inside the recessed body can be swung and moved to a vertical position, inspection and/or replacement of the light source tube/bulb can be done at the moved position easily and safely, and the light source tube/bulb can also be positioned at the center or any desired location within a limited space in the body, and it is thereby possible to improve a lighting effect of a shallow type downlight mechanism.

Further, the lamp socket can be drawn into the body together with the light source tube/bulb attached thereto. Therefore, even in the case of a fitting means using a housing which is previously set in a mounting hole in a ceiling, it is possible to perform operations without being disturbed by an object projected outside the embedded body attached underneath the housing.

In addition to forming a support for the lamp socket as the rotation fulcrum of the embedded body, by means of such a configuration as using a support shaft and guide slits for slidably fitting the support shaft therein or a structure in which the support shaft is secured by magnetic adsorption, a moving operation of the lamp socket and a light source tube/bulb attached thereto is facilitated and the body can be made more compact.

Since it is possible to move a lighting circuit member such as a stabilizer in and out of the body in a structure similar to the swing/moving means of the lamp socket, installation into the mounting hole can be done easily, and in particular this is ideal as a downlight apparatus for a means to set the recessed-type fixture in a mounting hole beforehand.

Also, by providing a power supply switch or a power supply connector whose circuit is closed only when the lamp socket is in the static support zone, the power supply circuit for said socket is automatically opened when said lamp socket is moved from the static support zone so that the lamp can be replaced safely under this condition.

As described above, according to a fixture of the present invention stated in claims 23 through 35, a center shaft tube and a light source tube/bulb or its support are provided at a fitting point of an installation surface of the lighting fixture, said light source tube/bulb protruding in a manner of a cantilever from the center shaft tube, and a rotatable joint is provided between said fitting point and the light source tube/bulb or its support to enable the light source tube/bulb to swing on a plain parallel to the installation surface. Therefore, the orientation of the light source tube/bulb in the installed fixture can optionally be changed, so that, when light source tube/bulbs are set in series along a ceiling of a shop floor or the like, it is possible to provide various types of lighting from local to diffusive by adjusting the orientations of the respective light source tube/bulbs. Also, as an arrangement of such light source tube/bulbs that presents a unique tubular pattern is effective as an interior decoration.

Further, by combining vertical variations, rotational variations and so on with the above, the orientation of the light source can freely be changed and thereby a reflection and a mirroring of lighting beams on a desk or display surface can be removed as needed.

Also, since lighting variations matching changes in a show window arrangement or a shop remodeling is possible when a lighting duct is used as a support for light source tube/bulbs, the luminaire according to the present invention is quite useful as a lighting means of this type.

Thus, according to an attachment device stated in claims 36 and 37 of the present invention, by fixing the same to the installation surface, it is possible to install a recessed-type fixture in a tubular body by holding a brim of the tubular body in the same manner as to hold it at the edge of mounting hole in the ceiling panel so that a conventional recessed-type fixture can easily be fitted in a condition that it is exposed from an installation surface.

Further, by providing a flexible joint, such as a pin, between said tubular body and a means for fixing the same to the installation surface, the orientation of the tubular body with respect to the installation surface can be changed. Also, by providing an intermediate member for hanging, such as a double-tube suspension pipe, it is possible to adjust a fitting height of the tubular body or the recessed-type fixture.

As described above, by using the present invention, a conventional recessed-type fixture can be used as an exposed-type to be mounted on an installation surface, imparting a unique effect on interior decoration, and further, the invention is particularly effective as a luminaire attached to, for example, a beam of an exposed ceiling.

Also, according to the apparatus of the present invention, by arranging a column for bridging a slab and a double-ceiling, with the upper portion of said column fixed to the slab and by holding extended edges provided at the lower portion of the column together with the edge of the mounting hole by holding pieces of mounting hole stopping means of the recessed-type fixture that is inserted through the mounting hole in the ceiling, the load of the fixture is borne by the column by way of the extended edges, and the ceiling panel can be secured to the slab. Therefore, even when a heavy recessed-type fixture is used, it can be fitted to a thin double-ceiling which can support only a limited load, while holding the ceiling panel at its position.

Further, by providing a height adjustment mechanism at the middle portion of the column, it is possible to cope with different distances between the slab and double-ceiling. Providing, in addition to this mechanism, a structure with an adjustable fixation position between the slab and an upper portion of the column, it is possible to fine-adjust the height of said column.

Moreover, with regard to a column shape, a simple saddle shape or a tubular shape effective for dusting and heat shielding, with only a provision for an open window to allow the holding piece to protrude at a part of the tube, can provide various fitting fixtures for individual purposes, and thus the apparatus according to the present invention is quite useful for practical purpose.

A fitting of the support device according to the present invention (for a heavy load or an elongated fixture) is on condition that fitting to a required point (a pertaining mounting hole) is done after a double-ceiling is formed.

Accordingly, it is a requisite that parts necessary for the support device are inserted through a small mounting hole in a double-ceiling and can be easily attached through a simple operation from an outside direction.

The present invention satisfies this requirement. (Conventionally, a heavy-weight chandelier is anchored to a slab, but it is different from the present invention in that it is not subject to the conditions with regard to mounting holes and a method of installation of a fixture.)

Of the two conventional methods of fitting a downlight fixture in a "mounting hole", the one using a plate spring, for example, has a drawback of a weight limit and fatigue. The method that calls for pulling down the holding pieces requires a complicated procedure for installation and there is a requisite that the reflector space is free.

If an embedded-type container already contains a whole apparatus (such as a smoke sensor, a heat sensor, etc.) or, in case of a fixture or a semi-recessed or a direct fitting type, a part of the fixture (such as a lighting circuit member of a luminaire), it is impossible to do blind fitting of the container into a "mounting hole" from a single external direction. The present invention proposing a recessed-type fixture which includes stopping mechanisms described above is the first to enable blind fitting of an embedded container already containing parts into a mounting hole in a double-ceiling.

With regard to downlights, the need for more economical discharge lamps (FDL) having superior energy saving characteristics is on the increase; actually, it is now the mainstream.

Effects of putting lighting circuit members essential for discharge lamps in a ceiling by using an embedded container and separating a shade containing a lamp are prominent in the following two points:

1. With regard to the needs to suppress heat generation, which is a fundamental problem in designing luminaires, a mutual interference between two heat generation sources, namely the lamp and the circuit, is eliminated.
2. Design flexibility is improved by making the exposed part, i. e. a shade in which a lamp is contained, compact and thin.

Said stopping mechanisms are directly attached to a single-type embedded container and indirectly to a unit-type embedded container. In case of indirect attachment, the embedded housing includes the stopping mechanisms, and the housing and the unit-type container are connected together according to the same method and by using the same configuration as those of the unit-type downlight fixture described above.

Industrial applicability

The present invention relates to an indoor luminaire, but by utilizing an attachment device thereof, it is possible to install a variety of electronic display apparatuses, monitoring apparatuses, alarm devices, other sensors and the like, and thus various fixtures and apparatuses can be installed by utilizing mounting holes in ceilings.

What is claimed is:

1. A fixture to be installed in a mounting hole in a ceiling, comprising:

a flange to be brought into contact with a front face of said mounting hole, a tubular embedded housing having an open end provided as an integral body with an inner periphery of said flange;

a lamp casing inserted from said open end, said lamp casing including a light source setting portion, an engagement portion formed around a lower part of an outer circumferential wall of said light source setting portion and piercing holes formed in said engagement portion;

said housing being provided with a connection means for connection to a distribution cable, said connection means being provided between said housing and said lamp casing;

a mechanical stopping means;

an electric wiring means including a connector connected to said stopping means; and a plurality of housing stopping mechanisms, each of which includes a support frame, a threaded shaft rotatably attached to said support frame, and a projected piece having a first end screwed to said threaded shaft and a second free end, said projected piece so arranged as to swing and at the same time to advance or retreat along said threaded shaft together with rotation of said threaded shaft, a swinging range of said projected piece being limited by contact with said support frame when said projected piece is swung by rotation of said threaded shaft to which said projected piece is attached, said housing stopping mechanisms attached to a wall of said tubular embedded housing through said piercing holes by means of an operation tool in such a manner as to permit said threaded shafts to rotate.

2. A fixture according to claim 1, further comprising:

a fitting means in said tubular embedded housing, for fitting said tubular embedded housing in said mounting hole;

a wiring means in said tubular embedded housing;

a lamp casing, effective to simultaneously connect electrically and mechanically to said housing by a mounting action from a front side of said mounting hole;

a sensor, effective to sense mounting of said lamp casing at a predetermined position; and a switch disposed in a power supply circuit for said lamp casing, said switch closing said power supply circuit when said sensor senses said lamp casing is at said predetermined position, and opening said power supply circuit when said lamp casing is not at said predetermined position.

3. A fixture according to claim 1, wherein:

said sensor includes a rotation lever having one end supported by said lamp casing and another end protruding outside of said lamp casing, and also includes a spring constantly biasing said lever in such a direction as to protrude; and said switch is a normally closed switch driven by said rotation lever.

4. A fixture according to claim 1 wherein:

said fixture is a recessed fixture; and said sensor and said switch are provided near a final mounting position at a lower portion of said lamp casing, and wiring members for connecting a bulb socket disposed at an upper portion of said lamp casing to said switch are embedded in U-grooves provided long an outer wall of said lamp casing.

5. A fixture according to claim 1, wherein said switch has plug blade electrodes for connection to an external power supply cable.

6. A fixture according to claim 1, wherein said connection means in said embedded housing is a receptacle equipped with a feed terminal block disposed along a peripheral wall of said housing so as to be located in a gap that is formed between an inner surface of said tubular peripheral wall of said housing and an outer wall of said lamp casing when said lamp casing is inserted therein.

7. A fixture according to claim 6, wherein said receptacle is formed as an integral body with said peripheral wall of said housing.

8. A fixture according to claim 6, wherein wire intakes of said receptacle are arranged in parallel along said tubular peripheral wall of said housing.

9. An attachment device of a fixture to be installed in a mounting hole in a ceiling, said attachment device comprising:

a tubular body having a brim with an inside diameter corresponding to a diameter of a mounting hole for embedding said attachment device in said ceiling;

a fixing means to fix said device to an installation surface provided at one end of said attachment device;

a flexible joint provided between said fixing means and said tubular body effective to vary orientation of said housing with respect to said installation surface; and said fixture being inserted and stopped from another end of said attachment device by a means similar to that used for installation into a mounting hole in a ceiling.

10. An attachment device of a fixture according to claim 9, wherein a middle portion member for hanging is provided between said fixing means and said tubular body so that a height of said tubular body can be changed with respect to said installation surface.

* * * * *